US011793367B2

(12) United States Patent
Steinke

(10) Patent No.: US 11,793,367 B2
(45) **Date of Patent: *Oct. 24, 2023**

(54) TOILET PAPER HOLDER SYSTEMS AND METHODS

(71) Applicant: Theodore R. Steinke, Golden, CO (US)

(72) Inventor: Theodore R. Steinke, Golden, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/071,224

(22) Filed: Nov. 29, 2022

(65) Prior Publication Data

US 2023/0284840 A1 Sep. 14, 2023

Related U.S. Application Data

(63) Continuation of application No. 17/209,505, filed on Mar. 23, 2021, now Pat. No. 11,529,027.

(60) Provisional application No. 63/004,091, filed on Apr. 2, 2020.

(51) Int. Cl.
*A47K 10/22* (2006.01)
*A47K 10/40* (2006.01)

(52) U.S. Cl.
CPC ..... *A47K 10/22* (2013.01); *A47K 10/40* (2013.01)

(58) Field of Classification Search
None
See application file for complete search history.

(56) References Cited

U.S. PATENT DOCUMENTS

| | | | | |
|---|---|---|---|---|
| 5,868,345 | A | 2/1999 | Beisser | |
| 5,871,170 | A | 2/1999 | Morales et al. | |
| 5,967,452 | A | 10/1999 | Wilder | |
| 6,405,971 | B1 | 6/2002 | Trecartin | |
| 6,527,219 | B1 | 3/2003 | Trecartin | |
| 7,306,185 | B1 | 12/2007 | Miller | |
| 7,360,739 | B1 | 4/2008 | Horvat | |
| D782,843 | S | 4/2017 | Thompson | |
| 10,743,725 | B2 | 8/2020 | Scheimberg | |
| 11,529,027 | B2 * | 12/2022 | Steinke | A47K 10/40 |
| 2005/0029392 | A1 | 2/2005 | Guay et al. | |
| 2018/0228322 | A1 | 8/2018 | Goodman et al. | |
| 2021/0307568 | A1 | 10/2021 | Steinke | |

FOREIGN PATENT DOCUMENTS

| | | | |
|---|---|---|---|
| DE | 19545440 A1 | | 6/1997 |
| EP | 0 687 437 | * | 4/1995 |
| JP | 2005-152249 A | | 6/2005 |

OTHER PUBLICATIONS

HK MAR, "Modified "Go-Go Gadget" Ikea Toilet Paper Holder", Jan. 23, 2013, https:/content.instructables.com/pdfs/EG8/CCE:/HBNXVGQB/Modified-Go-Go-Gadget-Ikea-Toilet-Paper-Holder.pdf.

* cited by examiner

*Primary Examiner* — William A. Rivera
(74) *Attorney, Agent, or Firm* — Acuity IP, LLC; Nathan S. Cassell

(57) ABSTRACT

Systems and methods for holding dispensing a paper roll product. Exemplary systems include a wall mount, a first arm coupled with the wall mount via a first bearing mechanism, a second arm coupled with the first arm via a second bearing mechanism, a third arm coupled with the second arm via a third bearing mechanism, and a holder arm coupled with the third arm via a fourth bearing mechanism, the holder arm configured to support a paper product roll, such as a toilet paper roll.

13 Claims, 23 Drawing Sheets

TOILET PAPER HOLDER SYSTEMS AND METHODS

CROSS-REFERENCES TO RELATED APPLICATIONS

This application is a continuation of U.S. patent application Ser. No. 17/209,505 filed Mar. 23, 2021, which claims the benefit of U.S. Provisional Patent Application No. 63/004,091 filed Apr. 2, 2020. The content of each of the above filings is incorporated herein by reference.

BACKGROUND OF THE INVENTION

Embodiments of the present invention relate to the field of paper roll holders and dispensers, and in particular embodiments, to adjustable toilet paper roll holders and dispensers.

Toilet paper holders and dispensers can be mounted on a wall or other supporting structure, in the vicinity of a toilet, so that the toilet paper roll can be reached by a person who is using the toilet. Some known toilet paper holders include two supports which extend from a wall, with a spring-loaded collapsible spindle positioned between the two supports. The holder maintains the roll at a constant distance from the wall, for example to accommodate the maximum diameter of the roll. Although such holders are useful in many situations, still further improvements are desired. Embodiments of the present invention provide solutions to at least some of these outstanding needs.

BRIEF SUMMARY OF THE INVENTION

Embodiments of the present invention include toilet paper holder and dispenser systems and methods that can be used in any of a variety of bathroom situations. For example, because of the versatility of the swing arm and telescoping arm capabilities, exemplary toilet paper holder systems can place the center of a roll of toilet paper in more than 94% of locations within a rectangular area defined by the typical American 16" stud spacing of most wall builds and the fully extended combined length of a first arm and a second arm of the system. Exemplary systems also enable the convenient adjustment of the orientation of the roll of toilet paper, for example, back and forth between an over-the-top orientation and an under-the-roll orientation. Moreover, exemplary embodiments enable enhanced versatility of the swing arms and/or bearing mechanisms, and therefore the toilet paper holder system can be retracted and stowed out of the way tight against the mounting wall when not in use.

In one aspect, embodiments of the present invention encompass toilet paper holder and dispenser systems and methods for holding a roll of toilet paper. Exemplary systems include a wall mount, a first arm coupled with the wall mount via a first bearing mechanism, the first arm having a central longitudinal axis, a second arm coupled with the first arm via a second bearing mechanism, the second arm having a central longitudinal axis, a third arm coupled with the second arm via a third bearing mechanism, the third arm having a central longitudinal axis, and a holder arm coupled with the third arm via a fourth bearing mechanism, the holder arm having a proximal section and a distal section configured to support a roll of toilet paper, the proximal section having a central longitudinal axis. In some cases, the first bearing mechanism enables the first arm to pivot about a first axis relative to the mount, while the central longitudinal axis of the first arm remains perpendicular to the first axis. In some cases, the second bearing mechanism enables the second arm to pivot about a second axis relative to the first arm, while the central longitudinal axis of the second arm remains perpendicular to the second axis. In some cases, the third bearing mechanism enables the third arm to pivot about a third axis relative to the third bearing mechanism, while the central longitudinal axis of the third arm remains coaxial with the third axis. In some cases, the fourth bearing mechanism enables the proximal section of the holder arm to pivot about a fourth axis relative to the fourth bearing mechanism, while the central longitudinal axis of proximal section of the holder arm remains coaxial with the fourth axis and perpendicular to the third axis.

According to some embodiments, the second axis is perpendicular to the central longitudinal axis of the first arm. In some instances, the second axis is parallel with the first axis. In some instances, the third axis is parallel with the second axis. In some instances, the third axis is parallel with the first axis. In some instances, the third axis is parallel with the first axis and the second axis. In some instances, the distal section of the holder arm is parallel with the proximal section of the holder arm. In some instances, the third bearing mechanism enables the third arm to pivot about the third axis throughout a 360° angle of rotation. In some instances, the central longitudinal axis of the third arm is perpendicular to the central longitudinal axis of the second arm. In some instances, the distal section of the holder arm has a hook that is configured to prevent the roll of toilet paper from sliding off the distal section.

In another aspect, embodiments of the present invention encompass methods for holding or supporting a roll of toilet paper on a toilet paper holder and dispenser system. Exemplary methods may include placing the roll of toilet paper on a distal section of a holder arm of a toilet paper holder system, where the holder arm is rotatably coupled with a third arm of the toilet paper holder system, the third arm is rotatably coupled with a second arm of the toilet paper holder system, the second arm is rotatably coupled with a first arm of the toilet paper holder system, the first arm is rotatably coupled with a wall mount of the toilet paper holder system, and the wall mount is secured to a wall. Methods may also include rotating the third arm of the toilet paper holder system, so as to place the roll of toilet paper in an under-the-roll orientation. In some cases, methods may include rotating the third arm of the toilet paper holder system, so as to place the roll of toilet paper in an over-the-top orientation. In some cases, the first arm is coupled with the wall mount via a first bearing mechanism. In some cases, the second arm coupled is with the first arm via a second bearing mechanism. In some cases, the third arm is coupled with the second arm via a third bearing mechanism. In some cases, the third bearing mechanism enables the third arm to pivot about a third axis throughout a 360° angle of rotation. In some cases, the holder arm is coupled with the third arm via a fourth bearing mechanism. In some cases, the holder arm has a hook that is configured to prevent the roll of toilet paper from sliding off the distal section of the holder arm. In some cases, the toilet paper holder system is configured to place a center of the roll of toilet paper in more than 94% of locations within a rectangular area defined by a typical American 16" stud spacing and a fully extended combined length of the first arm and the second arm 130.

DETAILED DESCRIPTION OF THE INVENTION

All illustrations of the drawings are to be describing selected embodiments of the present invention and are not intended to limit the scope of the present invention. All references of user or users pertain to either individual or individuals who would utilize embodiments of the present invention.

Figure 1:
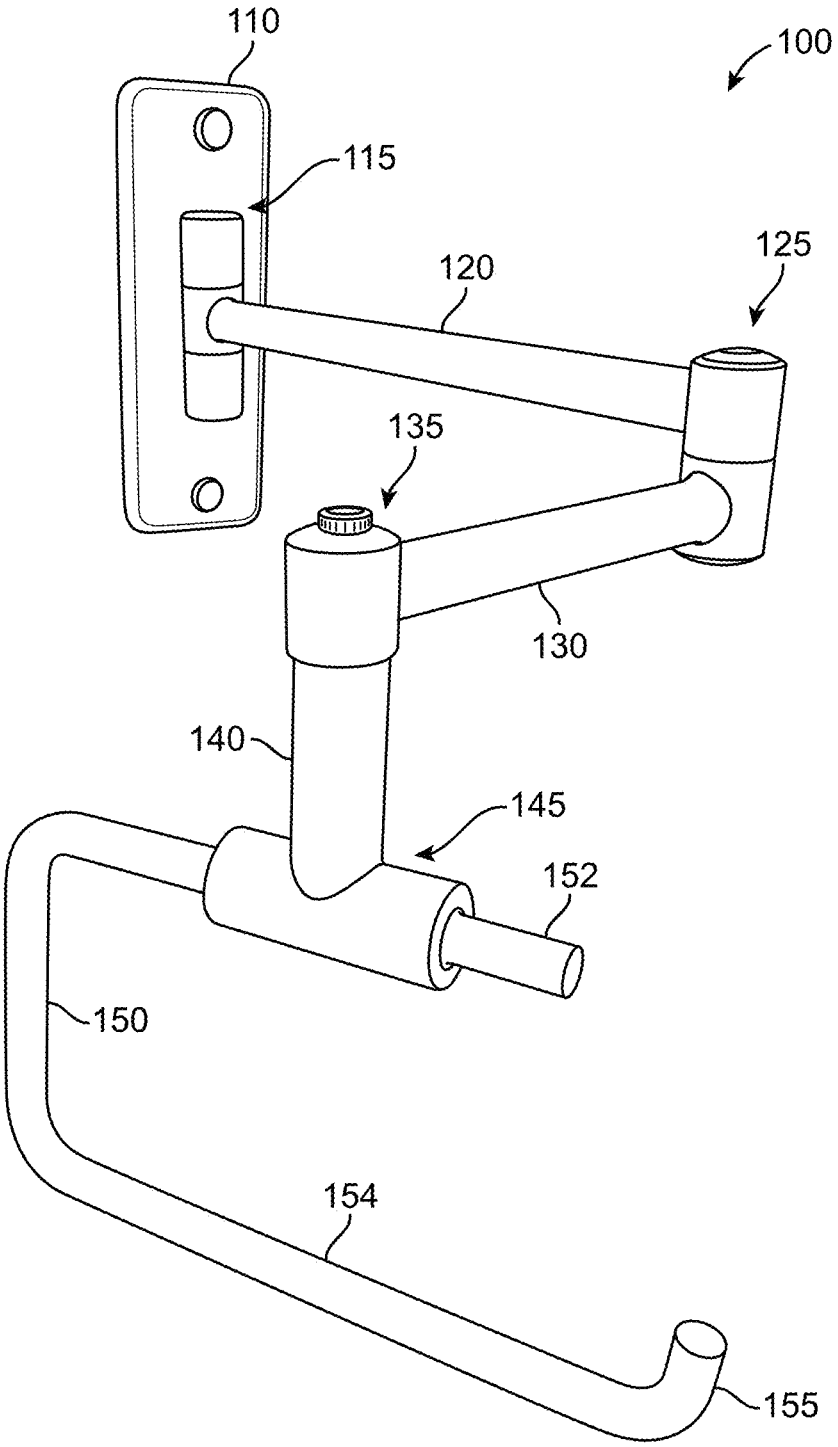
FIG. 1 provides a perspective view of aspects of a toilet paper holder and dispenser system, according to embodiments of the present invention.

Turning now to the drawings, FIG. 1 depicts a perspective view of a toilet paper holder system 100 according to embodiments of the present invention. As shown here, toilet paper holder system includes a wall mount 110, a first arm 120, a second arm 130, a third arm 140, and a holder arm 150. The first arm 120 is coupled with the wall mount 110 via a first bearing mechanism 115. The second arm 130 is coupled with the first arm 120 via a second bearing mechanism 125. The third arm 140 is coupled with the second arm 130 via a third bearing mechanism 135. The holder arm 150 is coupled with the third arm 140 via a fourth bearing mechanism 145. The holder arm 150 has a proximal section 152 and a distal section 154. The distal section 154 of the holder arm 150 is configured to support a roll of toilet paper (not shown).

Figure 2A:
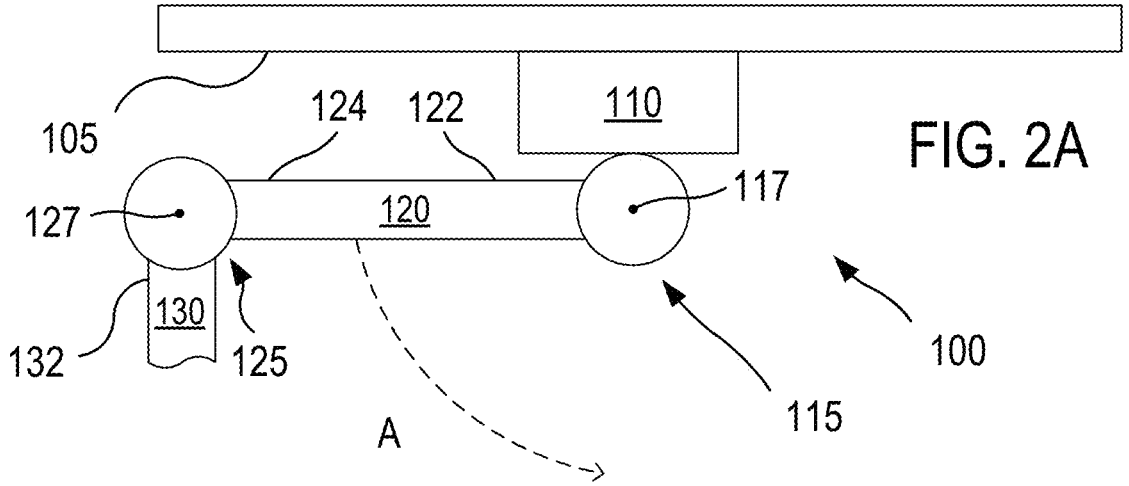
FIGS. 2A and 2B provide top plan views of aspects of a toilet paper holder and dispenser system, according to embodiments of the present invention.
Figure 2B:
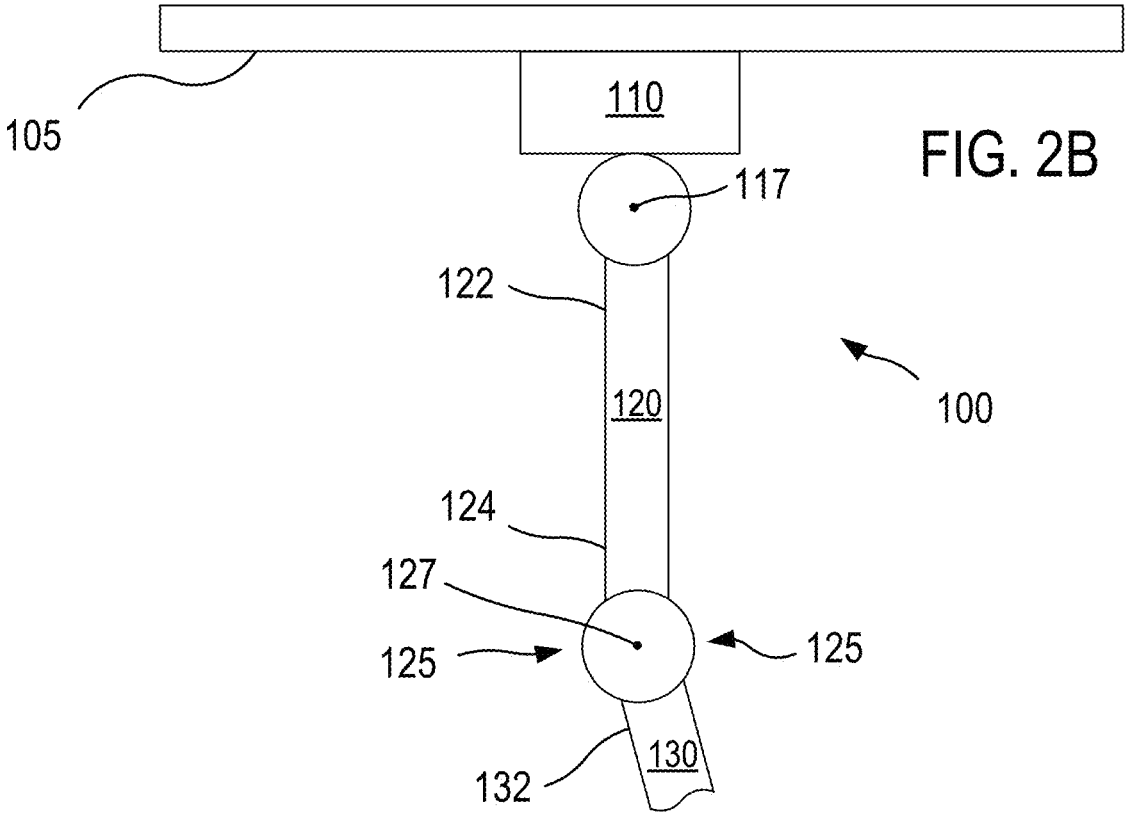

FIGS. 2A and 2B depict schematic top views of a portion of a toilet paper holder system 100 according to embodiments of the present invention. As shown here, toilet paper holder system 100 includes a wall mount 110 that is secured to a wall 105 of a building. For example, the wall 105 may be a wall located in a bathroom of the building. In some cases, the toilet paper holder system 100 may be affixed to some other type of structure other than a wall, for example a cabinet, a bathroom vanity, a stand, or the like. The toilet paper holder system 100 also includes a first arm 120 and a second arm 130 (partially shown here). The first arm 120 has a proximal portion 122 and a distal portion 124. The proximal portion 122 of the first arm is attached with the mount 110 via a first bearing mechanism 115. The distal portion 124 of the first arm is attached with a proximal portion 132 of the second arm 130 via a second bearing mechanism 125. As shown here, the first bearing mechanism 115 enables the first arm 120 to pivot about a first axis 117 throughout a range of motion. For example, the first bearing mechanism 115 can enable the first arm 120 to pivot about the first axis 117 in an arc A (e.g. angle of about 90°), relative to the wall 105 and/or the mount 110, from a first orientation (FIG. 2A) to a second orientation (FIG. 2B). As shown in FIG. 2A, the first arm 120 is generally parallel to the surface of wall 105, and in FIG. 2B, the first arm 120 is generally perpendicular to the surface of the wall 105. In some embodiments, the first bearing mechanism 115 enables the first arm 120 to pivot about the first axis 117 throughout an angular range of about 180°. As explained elsewhere herein, the second bearing mechanism 125 enables the second arm 130 to pivot about a second axis 127, throughout a range of motion, relative to the first arm 120.

Figure 3:
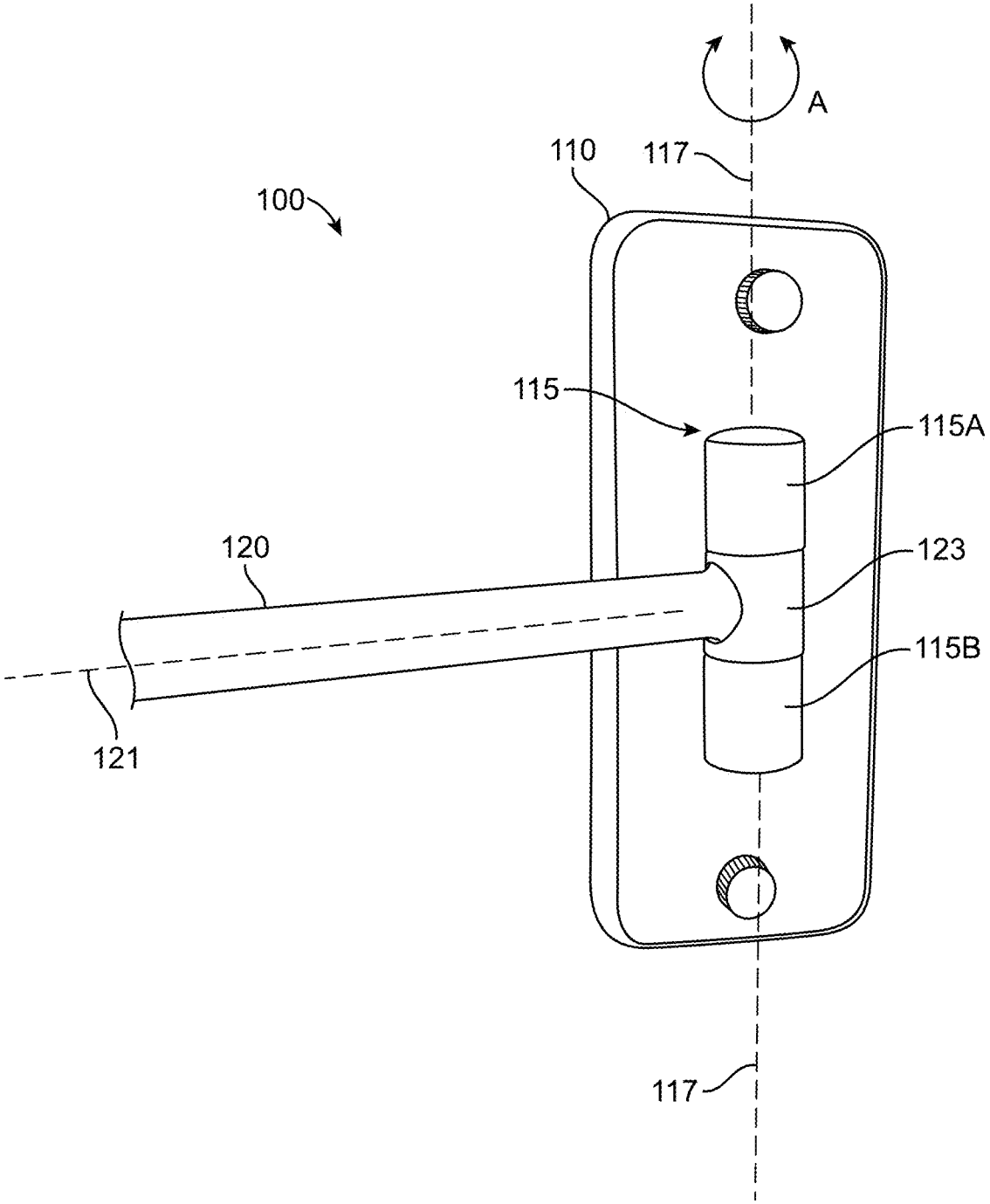
FIG. 3 provides a perspective view of aspects of a toilet paper holder and dispenser system, according to embodiments of the present invention.

FIG. 3 shows a close-up view of a portion of a toilet paper holder system 100 according to embodiments of the present invention. As shown here, toilet paper holder system 100 includes a mount 110 that can be secured to a wall of a building, or to some other structure as described elsewhere herein. The toilet paper holder system 100 also includes a first arm 120 pivotably coupled with the mount 110 via a first bearing mechanism 115. The first arm has a central longitudinal axis 121. As shown here, the first bearing mechanism 115 includes an upper mount knuckle 115A and a lower mount knuckle 115B. The first bearing mechanism 115 also includes a proximal first arm knuckle 123, disposed between the upper mount knuckle 115A and the lower mount knuckle 115B. In operation, the proximal first arm knuckle 123 can rotate relative to the upper mount knuckle 115A and the lower mount knuckle 115B. In some cases, the upper mount knuckle 115A and the lower mount knuckle 115B remain fixed relative to the mount 110, while the proximal first arm knuckle 123 swings or pivots relative to the mount 110. The first bearing mechanism 115 enables the first arm 120 to pivot about a first axis 117 throughout a range of motion. For example, the first bearing mechanism 115 can enable the first arm 120 to pivot about the first axis 117 throughout an arc A (e.g. angle of about 180°). In exemplary embodiments, first axis 117 can be parallel with the wall of a bathroom, and perpendicular to the floor of the bathroom.

FIG. 3 shows a close-up view of a portion of a toilet paper holder system 100 according to embodiments of the present invention. As shown here, toilet paper holder system 100 includes a mount 110 that can be secured to a wall of a building, or to some other structure as described elsewhere herein. The toilet paper holder system 100 also includes a first arm 120 pivotably coupled with the mount 110 via a first bearing mechanism 115. The first arm has a central longitudinal axis 121. As shown here, the first bearing mechanism 115 includes an upper mount knuckle 115A and a lower mount knuckle 115B. The first bearing mechanism 115 also includes a proximal first arm knuckle 123, disposed between the upper mount knuckle 115A and the lower mount knuckle 115B. In operation, the proximal first arm knuckle 123 can rotate relative to the upper mount knuckle 115A and the lower mount knuckle 115B. In some cases, the upper mount knuckle 115A and the lower mount knuckle 115B remain fixed relative to the mount 110, while the proximal first arm knuckle 123 swings or pivots relative to the mount 110. The first bearing mechanism 115 enables the first arm 120 to pivot about a first axis 117 throughout a range of motion. For example, the first bearing mechanism 115 can enable the first arm 120 to pivot about the first axis 117 throughout an arc A (e.g. angle of about 180°). In exemplary embodiments, first axis 117 can be parallel with the wall of a bathroom, and perpendicular to the floor of the bathroom.

According to some embodiments, the first bearing mechanism 115 can be provided as a hinge. In some cases, the first bearing mechanism can be provided as a barrel hinge. In some cases, the first bearing mechanism 115 can be provided as a pivot hinge. Any of a variety of hinges are contemplated for use as the first bearing mechanism, including center hung pivot hinges, spring pivot hinges, gravity pivot hinges, offset pivot hinges, raised barrel hinges, concealed or hidden barrel hinges, gate hinges, rotor hinges, and the like. First bearing mechanism 115 can operate to pivotably connect the mount 110 with the first arm 120, and can allow an angle of rotational movement between the mount 110 and the first arm 120 (e.g. first arm 120 swings throughout a range of motion while mount 110 remains stationary). In some cases, the first arm 120 rotates relative to the mount 110 about a fixed axis of rotation, whereby the first bearing mechanism 115 has one degree of freedom. In some embodiments, the first bearing mechanism 115 may provide two or more degrees of freedom.

Figure 4:
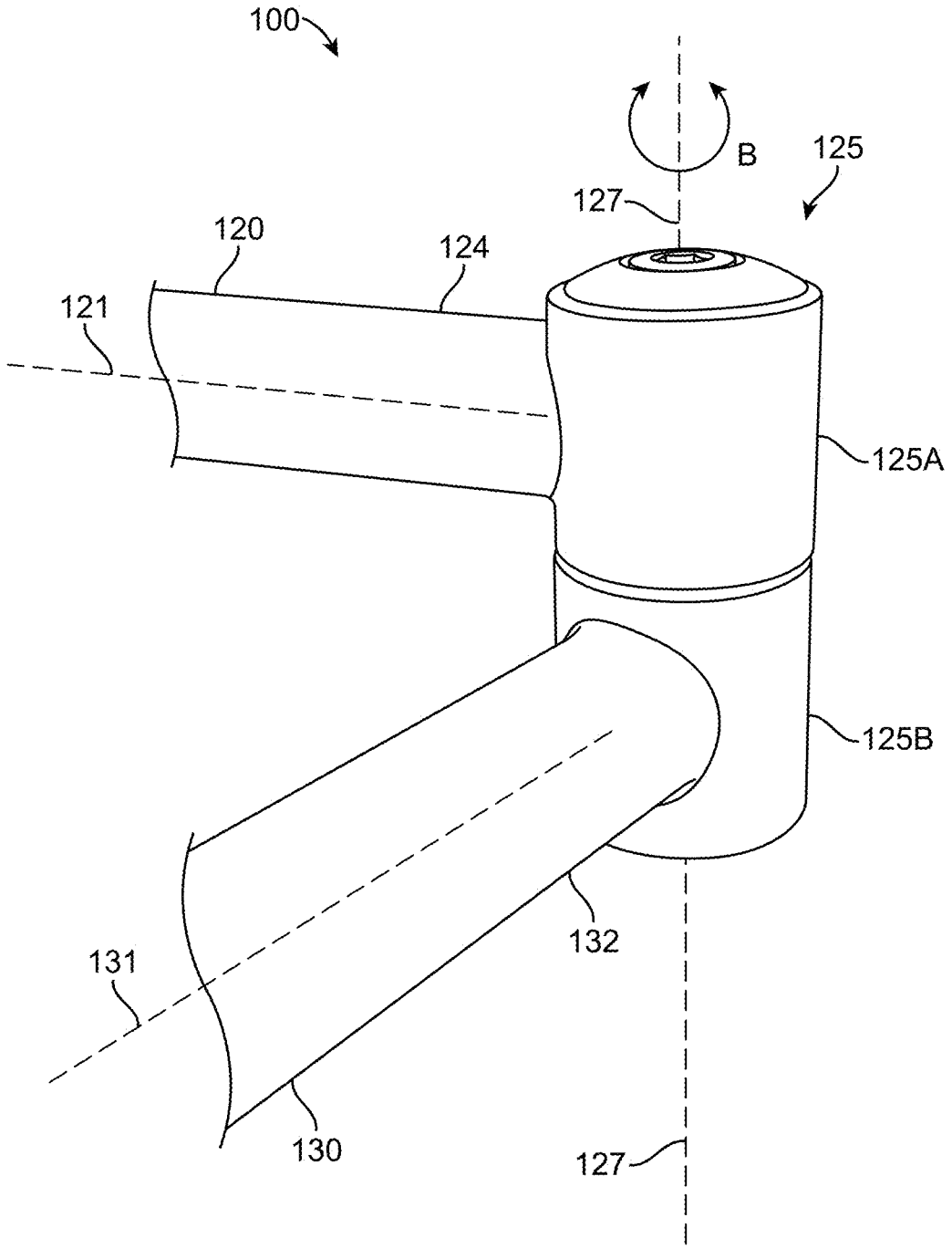
FIG. 4 provides a perspective view of aspects of a toilet paper holder and dispenser system, according to embodiments of the present invention.

FIG. 4 shows a close-up view of a portion of a toilet paper holder system 100 according to embodiments of the present invention. As shown here, toilet paper holder system 100 includes a first arm 120 pivotably or rotatably coupled with a second arm 130. For example, a distal portion 124 of the first arm can be attached with a proximal portion 132 of the second arm 130 via a second bearing mechanism 125. The second arm 130 has a central longitudinal axis 131. As shown here, the second bearing mechanism 125 includes a distal first arm knuckle 125A and a proximal second arm knuckle 125B. In operation, the first arm knuckle 123 can rotate relative to the upper mount knuckle 115A and the lower mount knuckle 115B. In operation, the distal first arm knuckle 125A and the proximal second arm knuckle 125B can rotate relative to one another. The second bearing mechanism 125 enables the second arm 130 to pivot about a second axis 127, throughout a range of motion, relative to the first arm 120. For example, the second bearing mechanism 125 can enable the second arm 130 to pivot about the second axis 127 throughout an arc B (e.g. angle of about 360°) relative to the first arm 120. In exemplary embodiments, second axis 127 can be parallel with the wall of a bathroom, and perpendicular to the floor of the bathroom. The second axis 127 can also be parallel with the first axis (e.g. first axis 117 depicted in FIG. 3). According to some embodiments, the second bearing mechanism 125 can be provided as a hinge, as described elsewhere herein.

Figure 5:
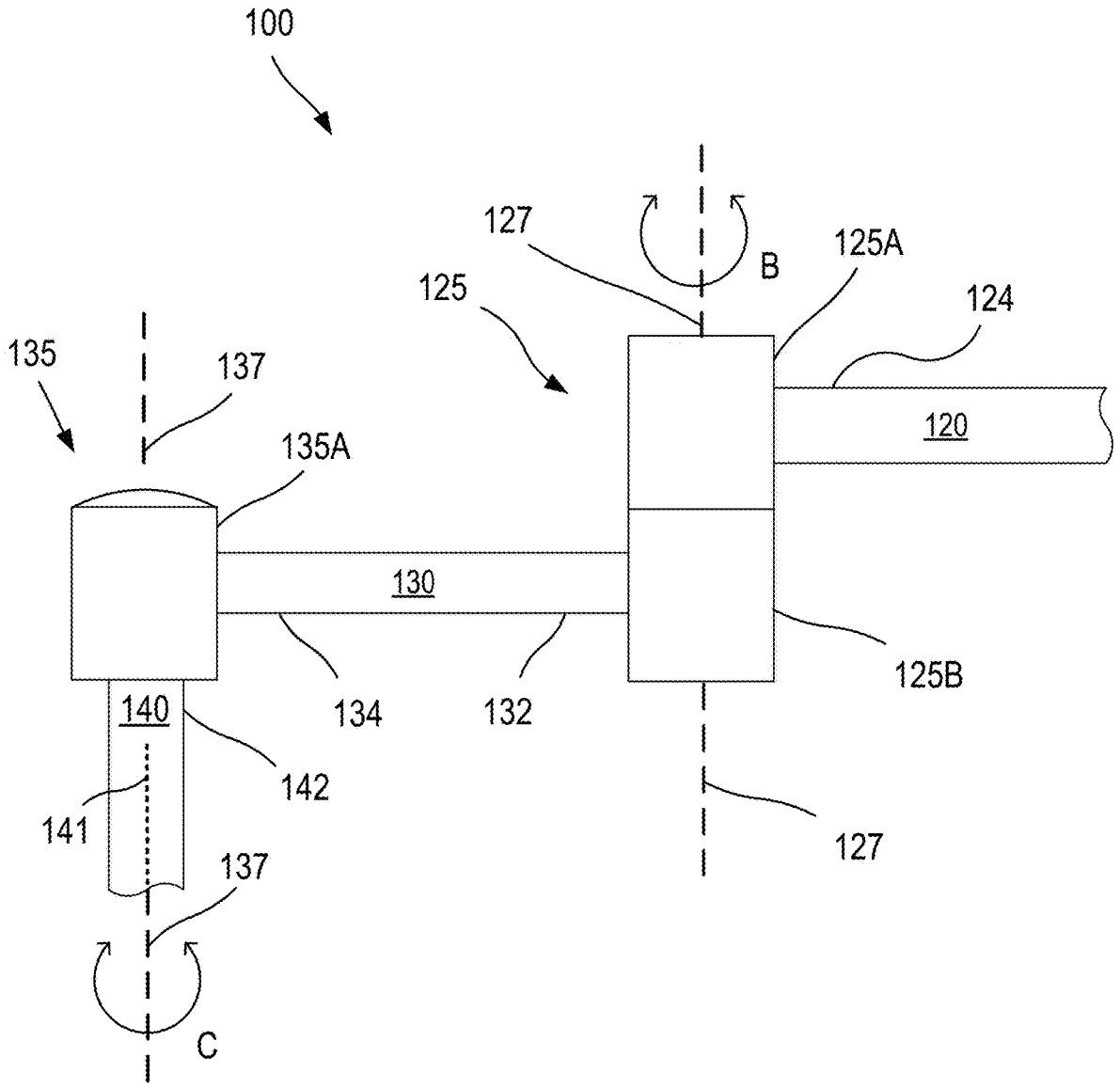
FIG. 5 provides a side view of aspects of a toilet paper holder and dispenser system, according to embodiments of the present invention.

FIG. 5 shows a close-up view of a portion of a toilet paper holder system 100 according to embodiments of the present invention. As shown here, toilet paper holder system 100 includes a first arm 120 pivotably coupled with a second arm 130 via a second bearing mechanism 125. The second bearing mechanism 125 can include a distal first arm knuckle 125A and a proximal second arm knuckle 125B. In some cases, a distal portion 124 of the first arm 120 can be pivotably attached with a proximal portion 132 of the second arm 130 via the second bearing mechanism 125. The second bearing mechanism 125 can enable the second arm 130 to pivot about a second axis 127, throughout a range of motion, relative to the first arm 120. For example, the second bearing mechanism 125 can enable the second arm 130 to pivot about the second axis 127 throughout an arc B (e.g. angle of about 360°) relative to the first arm 120. As further shown here, toilet paper holder system 100 includes a third arm 140 pivotably coupled with the second arm 130 via a third bearing mechanism 135. The third bearing mechanism 135 can include a distal second arm knuckle 135A. In some cases, a distal portion 134 of the second arm 130 can be pivotably attached with a proximal portion 142 of the third arm 140 via the third bearing mechanism 135. The third bearing mechanism 135 can enable the third arm 140 to pivot about a third axis 137, throughout a range of motion, relative to the second arm 130. For example, the third bearing mechanism 135 can enable the third arm 140 to pivot about the third axis 137 throughout a range of motion C (e.g. angle of about 360°) relative to the distal second arm knuckle 135A. In exemplary embodiments, the third axis 137 can be parallel with the wall of a bathroom, and perpendicular to the floor of the bathroom. The third axis 137 can also be parallel with the first axis (e.g. first axis 117 depicted in FIG. 3), and/or the second axis 127. According to some embodiments, the third bearing mechanism 135 can be provided as a hinge, as described elsewhere herein.

Figure 6:
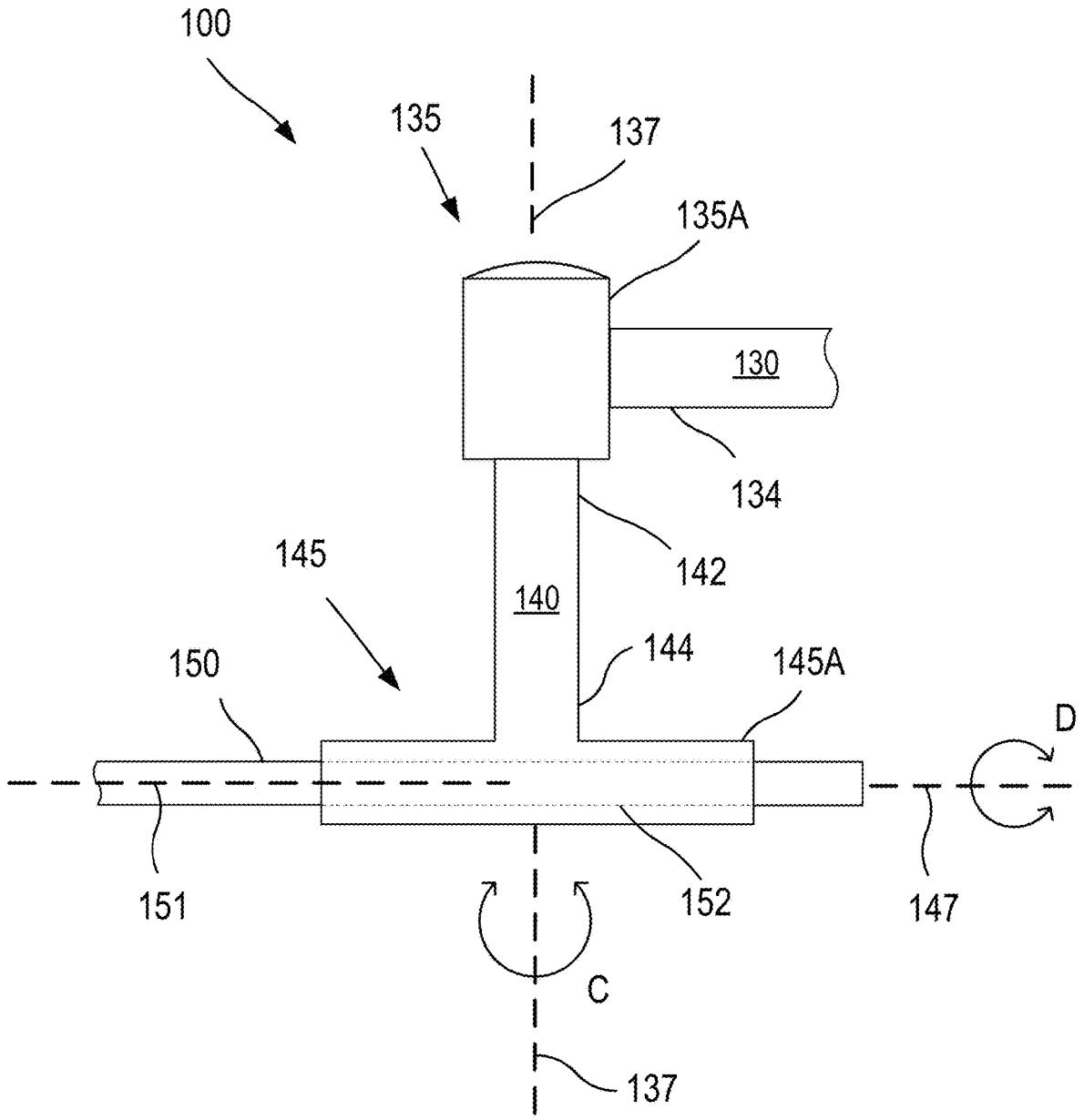
FIG. 6 provides a side view of aspects of a toilet paper holder and dispenser system, according to embodiments of the present invention.

FIG. 6 shows a close-up view of a portion of a toilet paper holder system 100 according to embodiments of the present invention. As shown here, toilet paper holder system 100 can include a third arm 140 pivotably coupled with a second arm 130 via a third bearing mechanism 135, and a holder arm coupled with the third arm 140 via a fourth bearing mechanism 145. The third bearing mechanism 135 can include a distal second arm knuckle 135A. In some cases, a distal portion 134 of the second arm 130 can be pivotably attached with a proximal portion 142 of the third arm 140 via the third bearing mechanism 135. The third bearing mechanism 135 can enable the third arm 140 to pivot about a third axis 137, throughout a range of motion, relative to the second arm 130. For example, the third bearing mechanism 135 can enable the third arm 140 to pivot about the third axis 137 throughout a range of motion C (e.g. angle of about 360°) relative to the distal second arm knuckle 135A. In exemplary embodiments, the third axis 137 can be parallel with the wall of a bathroom, and perpendicular to the floor of the bathroom. The third axis 137 can also be parallel with the first axis (e.g. first axis 117 depicted in FIG. 3), and/or the second axis (e.g. second axis 127 depicted in FIG. 5). According to some embodiments, the third bearing mechanism 135 can be provided as a hinge, as described elsewhere herein. The fourth bearing mechanism 145 can include a sleeve 145A. In some cases, a distal portion 144 of the third arm 140 can be pivotably attached with a proximal portion 152 of the holder arm 150 via the fourth bearing mechanism 145 (e.g. via sleeve 145A). The proximal section 152 has a central longitudinal axis 151. The fourth bearing mechanism 145 can enable the holder arm 150 to pivot about a fourth axis 147, throughout a range of motion, relative to the sleeve 145A. For example, the fourth bearing mechanism 145 can enable the holder arm 150 to pivot about the fourth axis 147 throughout a range of motion D (e.g. angle of about 360°) relative to the sleeve 145A. In exemplary embodiments, the fourth axis 147 can be set an any desired angle relative to the wall of a bathroom, and horizontal to the floor of the bathroom. The fourth axis 147 can also be perpendicular with the third axis (e.g. third axis 137). According to some embodiments, the fourth bearing mechanism 145 can be provided as a hinge, as described elsewhere herein.

According to some embodiments first arm 120, second arm 130, and/or third arm 140 can be manufactured to different lengths depending upon the desired application. In some embodiments, first arm 120, second arm 130, and/or third arm 140 can have adjustable lengths. In some embodiments, first arm 120, second arm 130, and/or third arm 140 can have telescoping capabilities. In some cases, second arm 130 has a telescoping capability and its length can be changed within certain limits. First arm 120 and second arm 130 can be interchangeable, and either arm can be attached at either end to bearing mechanisms 115, 125, and/or 135. Third arm 140 can be attached to either bearing mechanism 125 or 135. Third arm 140, fourth bearing mechanism 145, holder arm 150, holder arm proximal section 152, holder arm distal section 154, and hook 155 can be attached at the bearing mechanism that is being employed, most distal to wall mount 110. According to some embodiments, bearing mechanisms 115, 125, and/or 135 can be locked in any orientation by use of a set mechanism, such as a set screw. According to some embodiments, bearing mechanisms 115, 125, and/or 135 can be provided with a friction element, such as a fringe hinge. Because of this versatility the toilet paper holder system 100 can be modified for a multitude of applications and wall placements including using both first arm 120 and second arm 130, interchanging which arm (i.e. first arm 120 or second arm 130) is adjacent to wall mount 110, or using only a single arm, either first arm 120 or second arm 130.

According to some embodiments, wall mount 110 can be securely mounted into any wall stud using 2 screw anchors. Toilet paper holder system 100 can be either mounted on the opposite wall to where the toilet is mounted or on the adjacent wall to either side of where the toilet is mounted. In some cases, the toilet paper holder system 100 can be mounted at any height above the floor where a wall stud available. Because of the versatility of the swing arm and telescoping arm capabilities, the toilet paper holder system 100 can place the center of a roll of toilet paper in more than 94% of locations within a rectangular area defined by the typical American 16" stud spacing of most wall builds and the fully extended combined length of first arm 120 and second arm 130. In some embodiments, bearing mechanism 135 has the capability of rotating 360° about axis 137, and therefore the toilet paper holder system 100 has the capability of rotating the longitudinal axis of a roll of toilet paper 360° about axis 137 allowing for toilet paper to be dispensed at any orientation about axis 137. This adjustment of the orientation of the roll of toilet paper can be done easily by a person using only one hand. This allows the person to orient the dispensing direction of the toilet paper in an optimal orientation and also allows for the easy, one-handed, flipping of the roll dispensing rotational direction to either over-the-top or under-the-roll, according to the user's preference. For example, one user may wish to have the roll of toilet paper in an over-the-top orientation, whereas another user may wish to have the roll of toilet paper in an under-the-roll orientation. The adjustable nature of the toilet paper holder system 100 can allow users to switch between such orientations easily and efficiently, without having to remove the roll of toilet paper from the toilet paper holder system. Moreover, exemplary embodiments enable enhanced versatility of the swing arms and/or bearing mechanisms, and therefore the toilet paper holder system 100 can be retracted and stowed out of the way tight against the mounting wall when not in use.

According to some embodiments, the diameter of the roll of toilet paper loaded onto the toilet paper holder system 100 may limit how tight the system can be retracted against the wall. In some embodiments, it is desirable to position the mounting locations on either the opposite or adjacent wall at an appropriate distance, so that the toilet paper holder system 100 can reach an optimal position in its most extended position. In exemplary embodiments, the toilet paper holder system 100 will operate to place a toilet paper roll in an optimal dispensing position while providing a more secure wall stud attachment in between 50% and 90% of current American toilet paper dispensing systems and applications.

Figure 7:
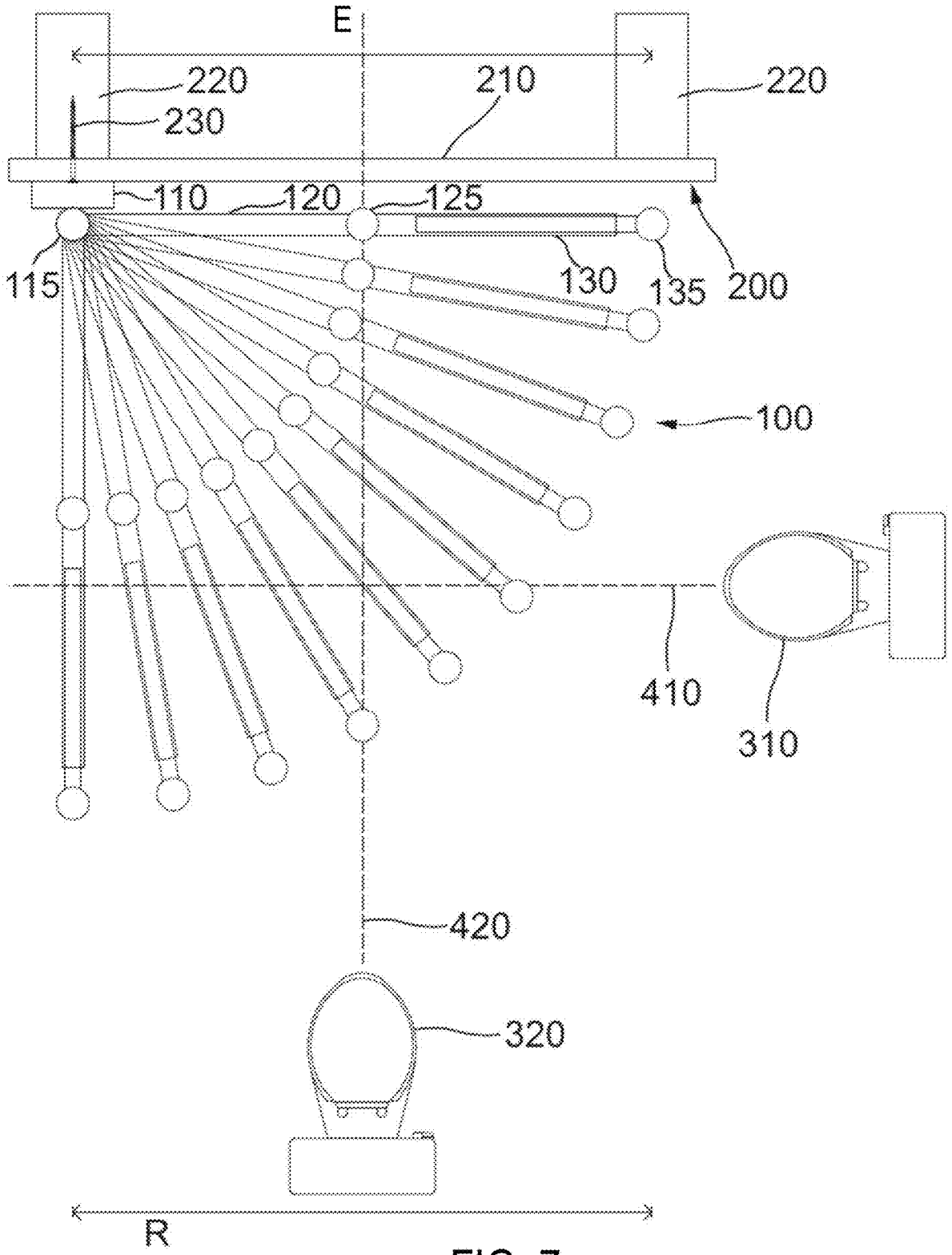
FIG. 7 provides a top plan view of aspects of a toilet paper holder and dispenser system, according to embodiments of the present invention.
Figure 8:
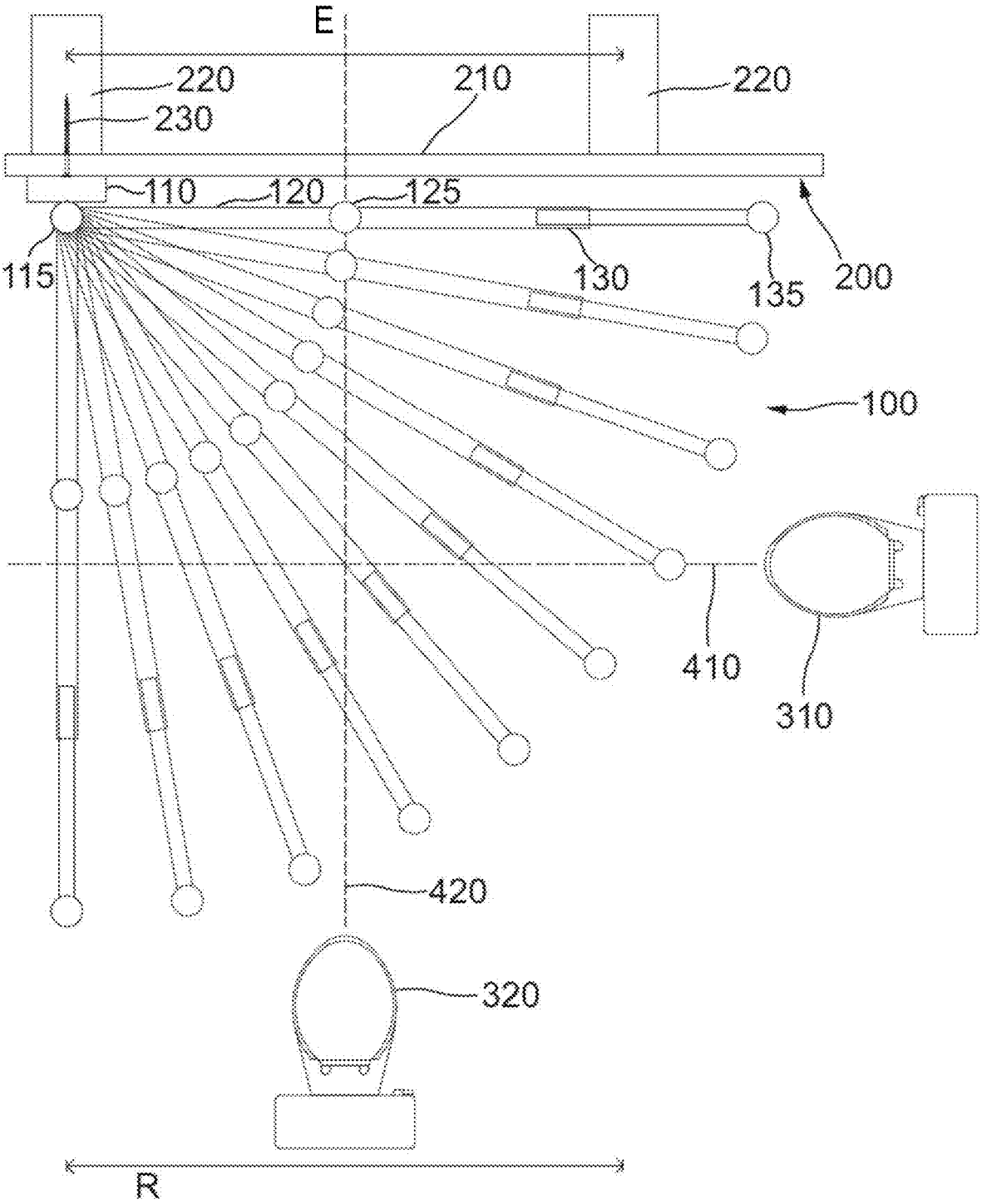
FIG. 8 provides a top plan view of aspects of a toilet paper holder and dispenser system, according to embodiments of the present invention.

FIGS. 7 and 8 show aspects of an exemplary toilet paper holder system 100, according to embodiments of the present invention. In some cases, first arm 120 may have a length of about 8 inches. In some cases, second arm 130 can be a telescoping arm, having a length that is adjustable between about 7 inches and about 12 inches. First arm 120 can be coupled with second arm 130 via a second bearing mechanism 125. A typical American wall 200 can include a sheet of drywall 210 having a thickness of about ⅝ inches, which is attached to 2 inch×4 inch wall studs 220 arranged 16 inches on center E. As shown here, a wall mount 110 can be secured to the wall via a screw anchor 230. The plan view shown in these figures demonstrates some of the versatility in capability of the toilet paper holder system 100 in placing the center of a roll of toilet paper (e.g. represented by or corresponding to the most distal bearing mechanism from wall mount 110, in this case bearing mechanism 135), in a variety of locations relative to certain toilet locations. For example, toilet location 310 that is at an adjacent wall, or toilet location 320 that is at an opposite wall (e.g. having a range R of lateral position). The toilet paper holder system 100 is also capable of any toilet paper roll placements represented by flipping the diagram about either of the two mirror planes represented (410, 420). These toilet drawings are merely for diagrammatic purposes and are not drawn to scale or meant to represent actual toilet locations. The toilets shown at toilet locations 310, 320 may not be illustrated to scale.

Figure 9:
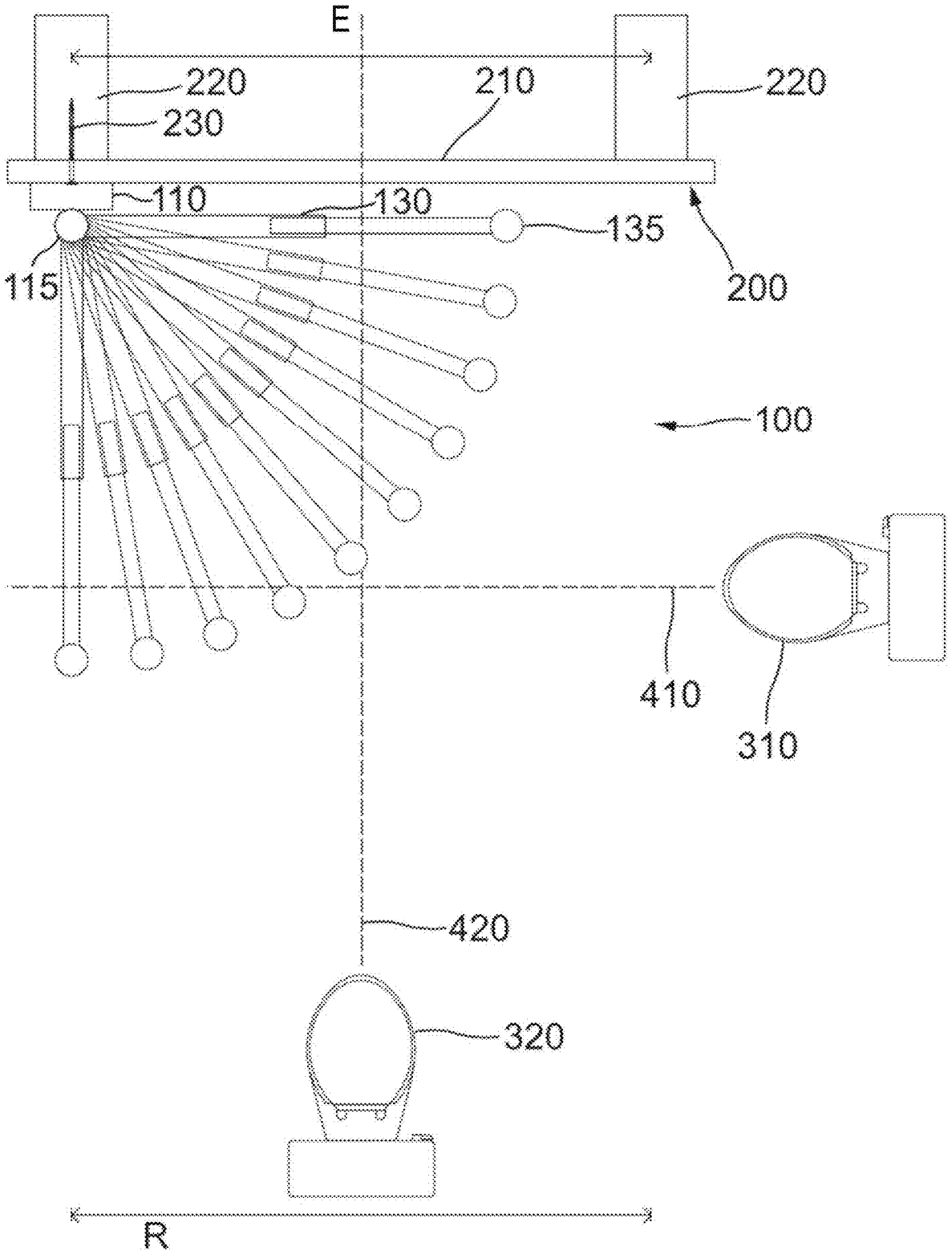
FIG. 9 provides a top plan view of aspects of a toilet paper holder and dispenser system, according to embodiments of the present invention.

FIG. 9 show aspects of an exemplary toilet paper holder system 100, according to embodiments of the present invention. As shown here, the toilet paper holder system 100 includes an arm 130 having a proximal section that is coupled with a bearing mechanism 115 and a distal section that is coupled with a bearing mechanism 135. There is no arm 120 such as that depicted in FIG. 8, for example. In some cases, arm 130 can be a telescoping arm, having a length that is adjustable between about 7 inches and about 12 inches. A typical American wall 200 can include a sheet of drywall 210 having a thickness of about ⅝ inches, which is attached to 2 inch×4 inch wall studs 220 arranged 16 inches on center E. As shown here, a wall mount 110 can be secured to the wall via a screw anchor 230. The plan view shown in these figures demonstrates some of the versatility in capability of the toilet paper holder system 100 in placing the center of a roll of toilet paper (e.g. represented by or corresponding to the most distal bearing mechanism from wall mount 110, in this case bearing mechanism 135), in a variety of locations relative to certain toilet locations. For example, toilet location 310 that is at an adjacent wall, or toilet location 320 that is at an opposite wall (e.g. having a range R of lateral position). The toilet paper holder system 100 is also capable of any toilet paper roll placements represented by flipping the diagram about either of the two mirror planes represented (410, 420). These toilet drawings are merely for diagrammatic purposes and are not drawn to scale or meant to represent actual toilet locations.

Figure 10:
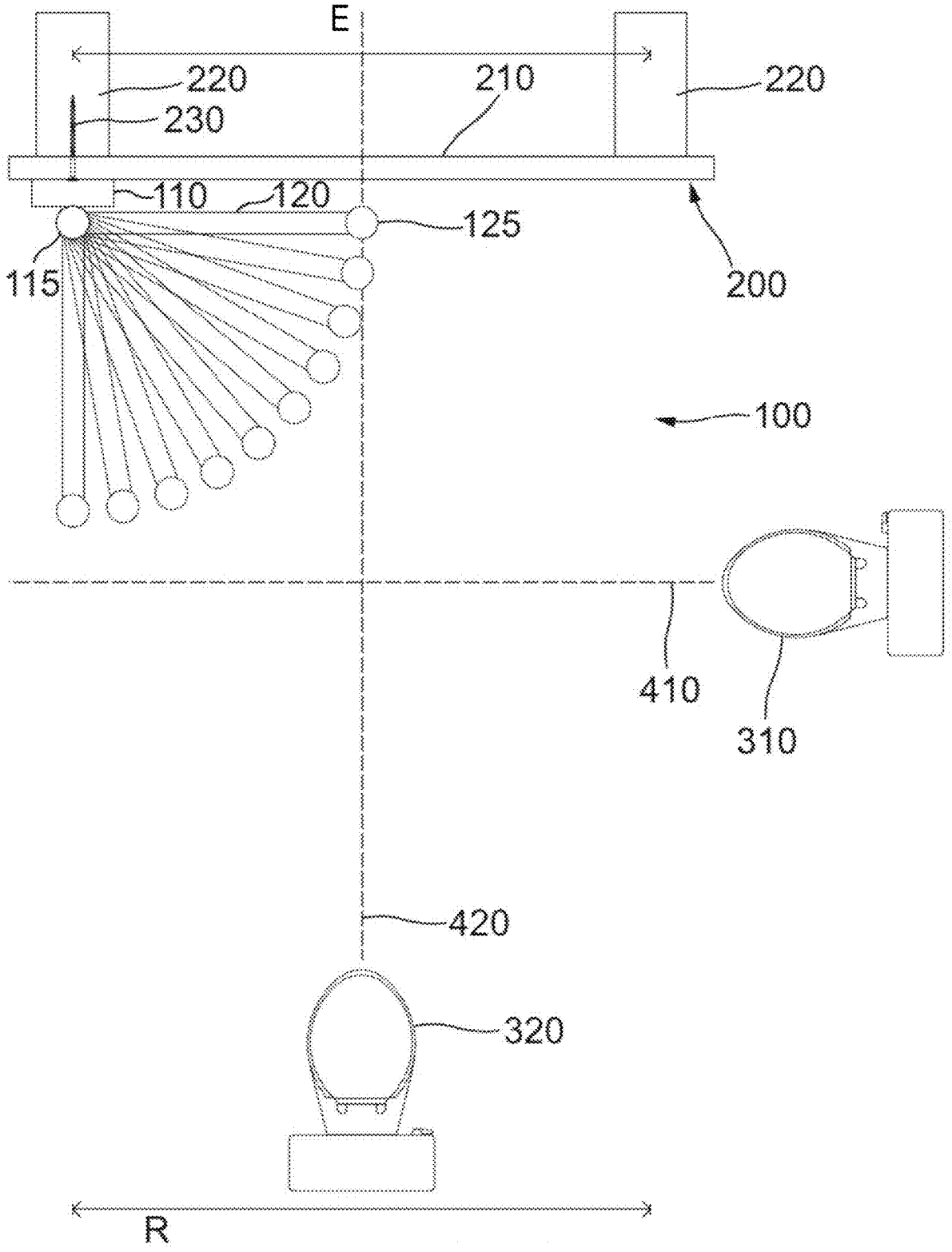
FIG. 10 provides a top plan view of aspects of a toilet paper holder and dispenser system, according to embodiments of the present invention.

FIG. 10 shows aspects of an exemplary toilet paper holder system 100, according to embodiments of the present invention. As shown here, the toilet paper holder system 100 includes an arm 120 having a proximal section that is coupled with a bearing mechanism 115 and a distal section that is coupled with a bearing mechanism 125. There is no arm 130 such as that depicted in FIG. 8, for example. In some cases, arm 120 can have a length that is about 8 inches. A typical American wall 200 can include a sheet of drywall 210 having a thickness of about ⅝ inches, which is attached to 2 inch×4 inch wall studs 220 arranged 16 inches on center E. As shown here, a wall mount 110 can be secured to the wall via a screw anchor 230. The plan view shown in these figures demonstrates some of the versatility in capability of the toilet paper holder system 100 in placing the center of a roll of toilet paper (e.g. represented by or corresponding to the most distal bearing mechanism from wall mount 110, in this case bearing mechanism 125), in a variety of locations relative to certain toilet locations. For example, toilet location 310 that is at an adjacent wall, or toilet location 320 that is at an opposite wall (e.g. having a range R of lateral position). The toilet paper holder system 100 is also capable of any toilet paper roll placements represented by flipping the diagram about either of the two mirror planes represented (410, 420). These toilet drawings are merely for diagrammatic purposes and are not drawn to scale or meant to represent actual toilet locations.

Figure 11:
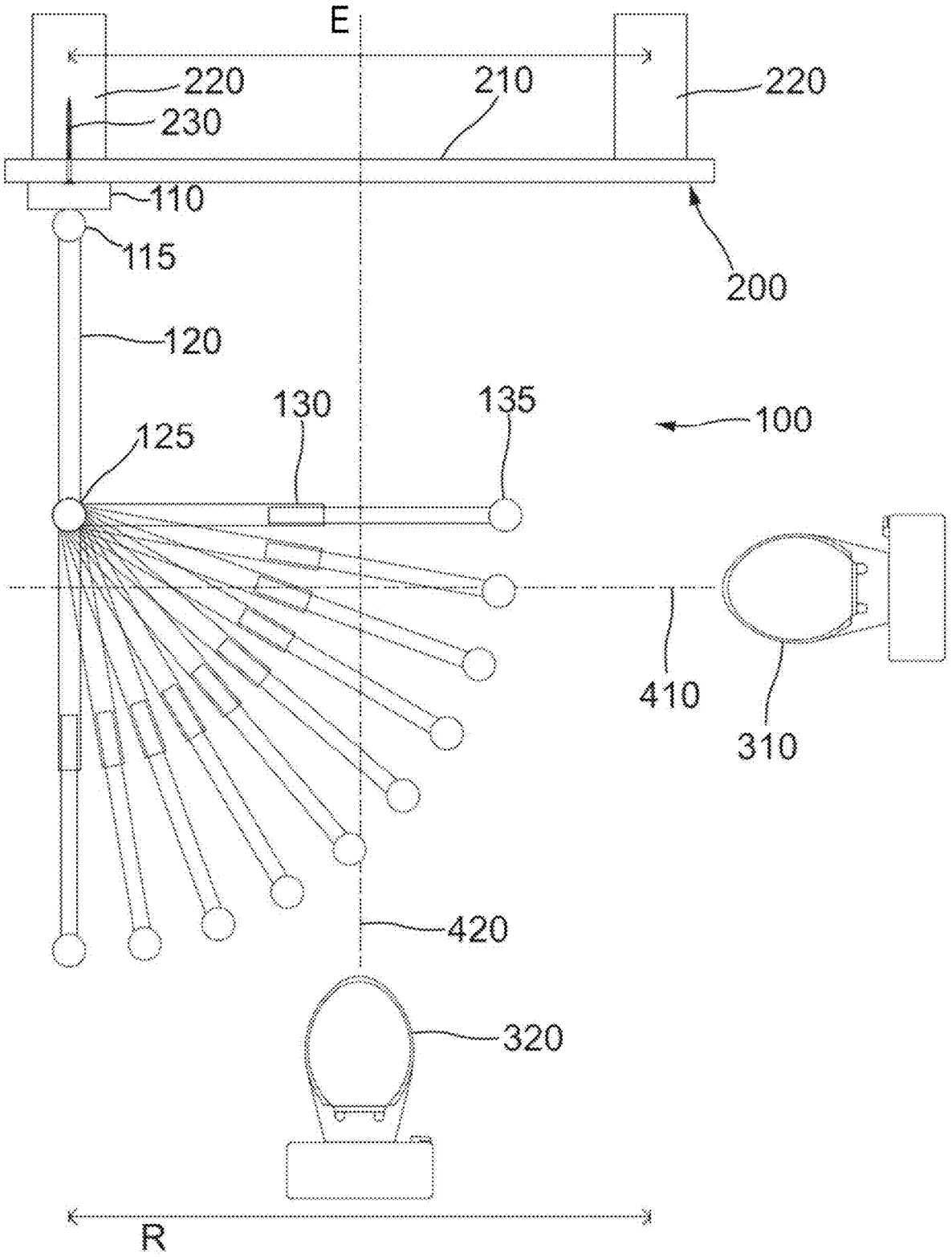
FIG. 11 provides a top plan view of aspects of a toilet paper holder and dispenser system, according to embodiments of the present invention.
Figure 12:
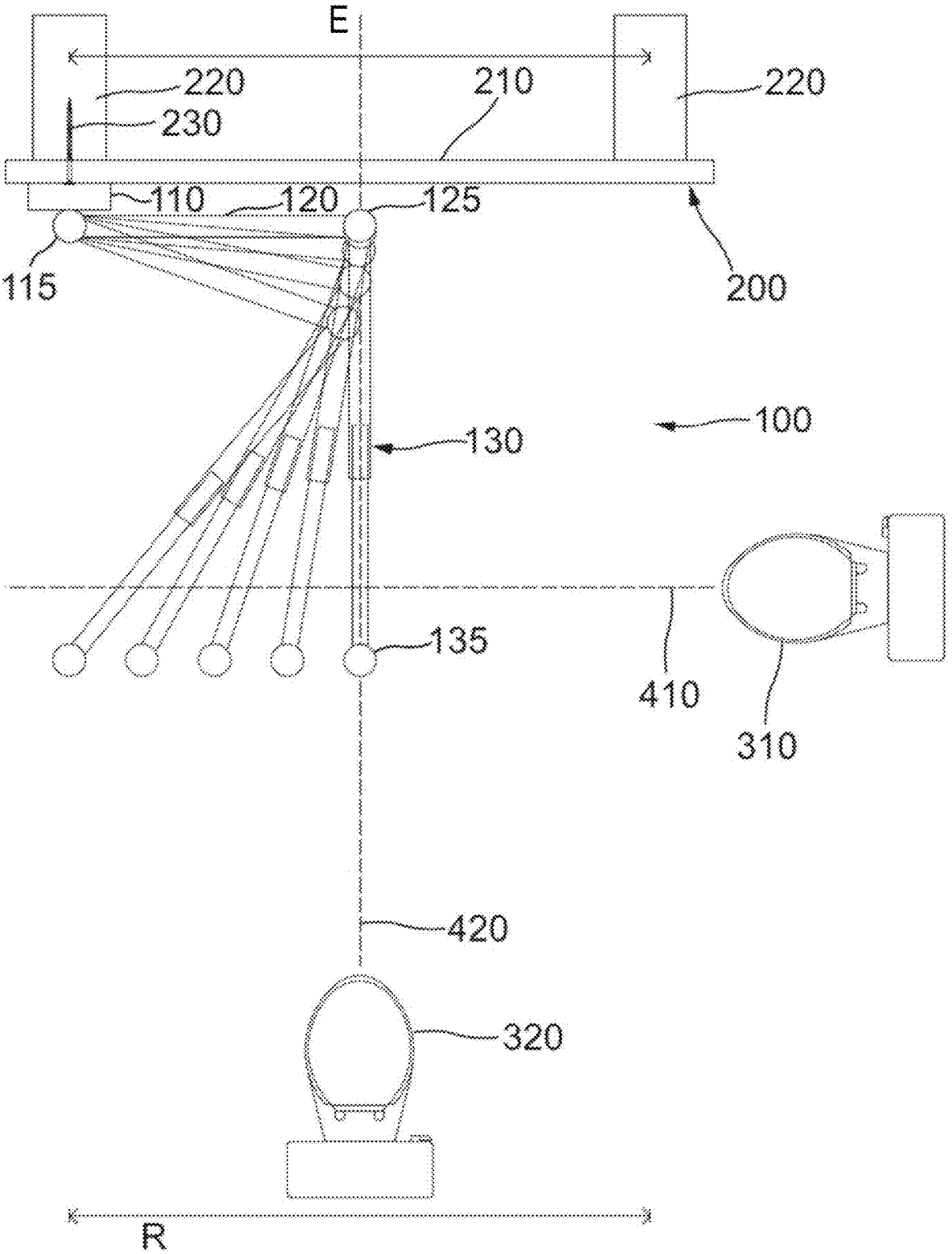
FIG. 12 provides a top plan view of aspects of a toilet paper holder and dispenser system, according to embodiments of the present invention.
Figure 13:
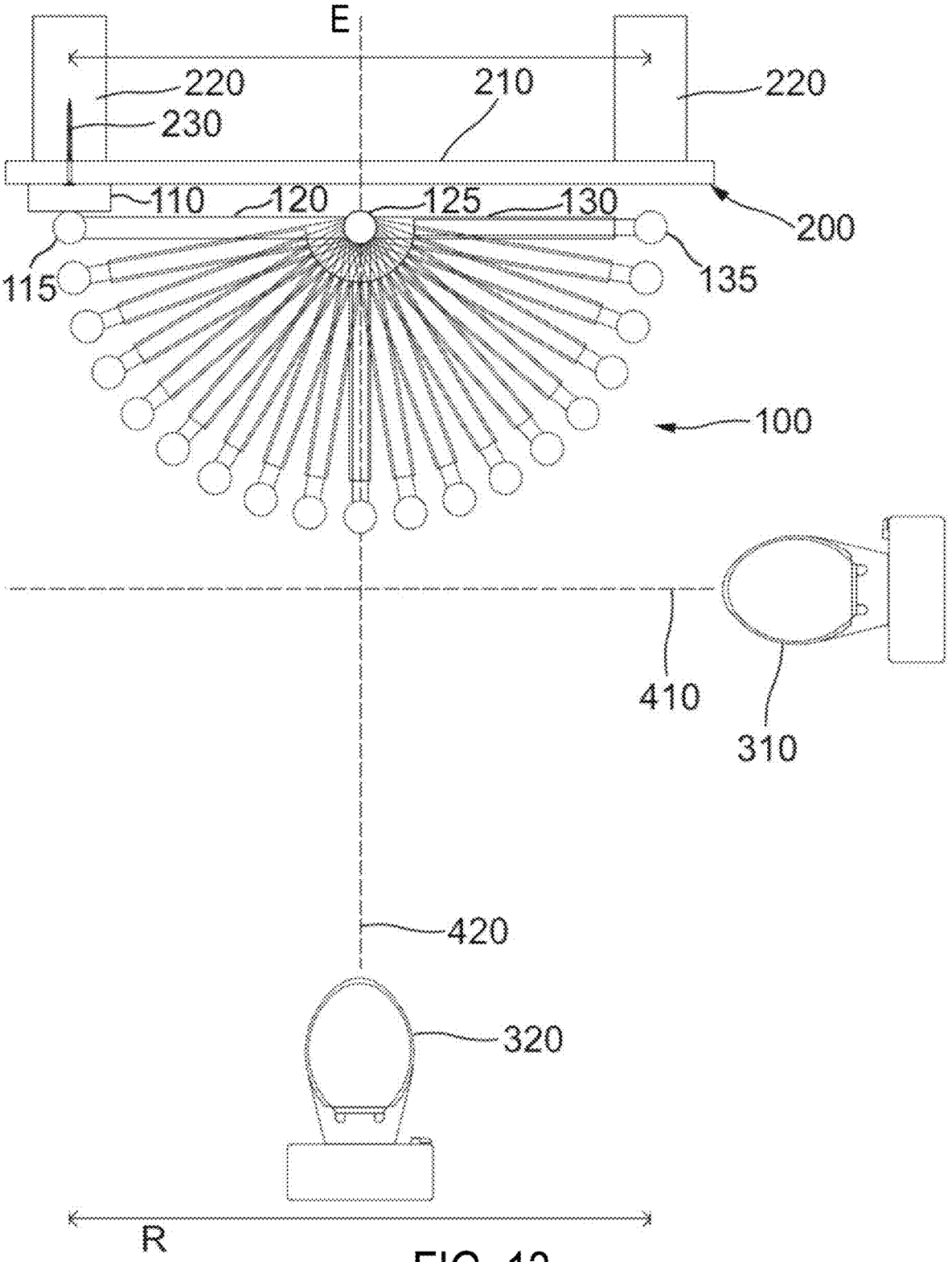
FIG. 13 provides a top plan view of aspects of a toilet paper holder and dispenser system, according to embodiments of the present invention.

FIGS. 11, 12, and 13 show aspects of an exemplary toilet paper holder system 100, according to embodiments of the present invention. In some cases, first arm 120 may have a length of about 8 inches. In some cases, second arm 130 can be a telescoping arm, having a length that is adjustable between about 7 inches and about 12 inches. First arm 120 can be coupled with second arm 130 via a second bearing mechanism 125. A typical American wall 200 can include a sheet of drywall 210 having a thickness of about ⅝ inches, which is attached to 2 inch×4 inch wall studs 220 arranged 16 inches on center E. As shown here, a wall mount 110 can be secured to the wall via a screw anchor 230. The plan view shown in these figures demonstrates some of the versatility in capability of the toilet paper holder system 100 in placing the center of a roll of toilet paper (e.g. represented by or corresponding to the most distal bearing mechanism from wall mount 110, in this case bearing mechanism 135), in a variety of locations relative to certain toilet locations. For example, toilet location 310 that is at an adjacent wall, or toilet location 320 that is at an opposite wall (e.g. having a range R of lateral position). The toilet paper holder system 100 is also capable of any toilet paper roll placements represented by flipping the diagram about either of the two mirror planes represented (410, 420). These toilet drawings are merely for diagrammatic purposes and are not drawn to scale or meant to represent actual toilet locations.

Figure 14:
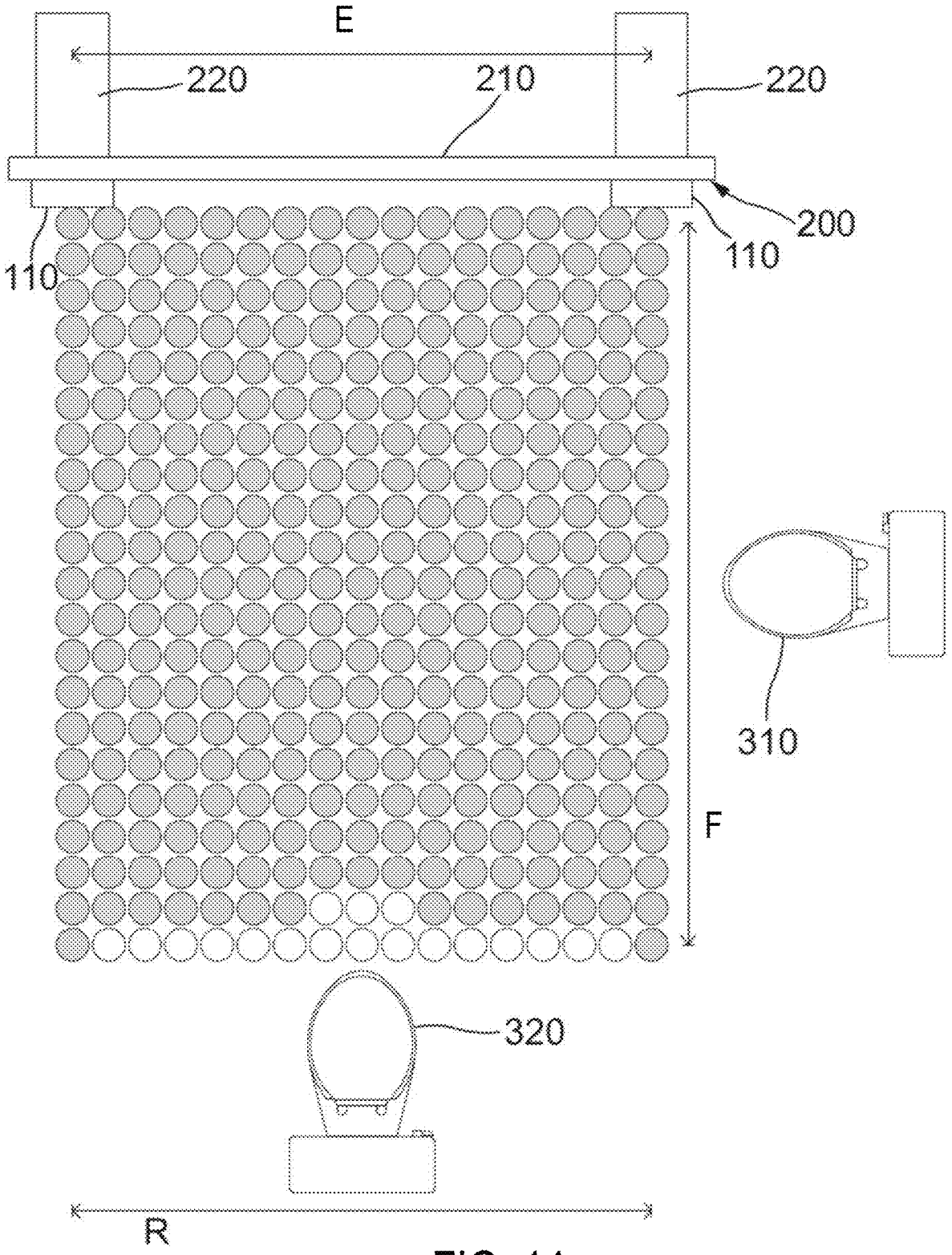
FIG. 14 provides a top plan view of aspects of a toilet paper holder and dispenser system, according to embodiments of the present invention.

The illustration provided in FIG. 14 assumes a toilet paper holder system 100 embodiment having a first arm having a length of about 8 inches and a second arm having a length that is adjustable between about 7 inches and about 12 inches. A typical American wall 200 can include a sheet of drywall 210 having a thickness of about ⅝ inches, which is attached to 2 inch×4 inch wall studs 220 arranged 16 inches on center E. This plan view diagram demonstrates some of the versatility in capability of the toilet paper holder system 100 in placing the center of a roll of toilet paper in a variety of locations relative to certain toilet locations. For example, toilet location 310 that is at an adjacent wall, or toilet location 320 that is at an opposite wall (e.g. having a range R of lateral position). The circles represent possible toilet paper roll center point locations on a 1"×1" grid within a rectangular area defined by the typical American 16 inch stud spacing of most wall builds and the fully extended combined length of a first arm and a second arm, in this case having a dimension F of about 20 inches. Because of the versatility of the swing arm and telescoping arm capabilities, the toilet paper holder system 100 can place the center of a roll of toilet paper in more than 94% of locations within that rectangular area. The grey circles represent locations that the toilet paper holder system 100 can place a roll of toilet paper and the white circles are locations it cannot place a roll of toilet paper. Toilet drawings are merely for diagrammatic purposes and are not drawn to scale or meant to represent actual toilet locations.

Figure 15B:
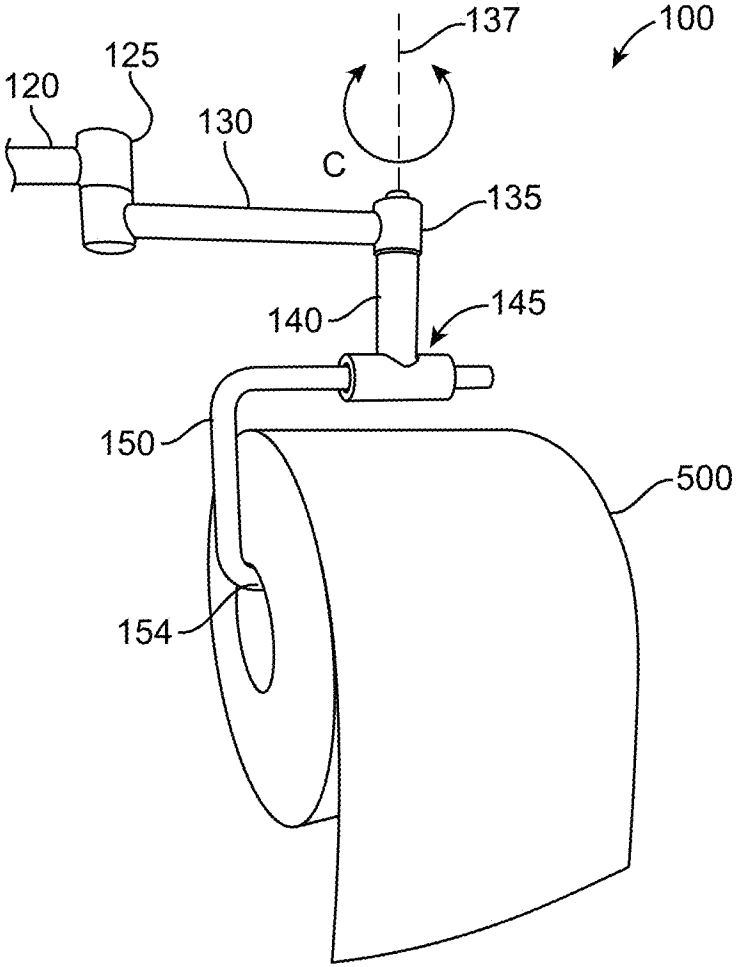
FIGS. 15A and 15B provide perspective views of aspects of a toilet paper holder and dispenser system, according to embodiments of the present invention.
Figure 15A:
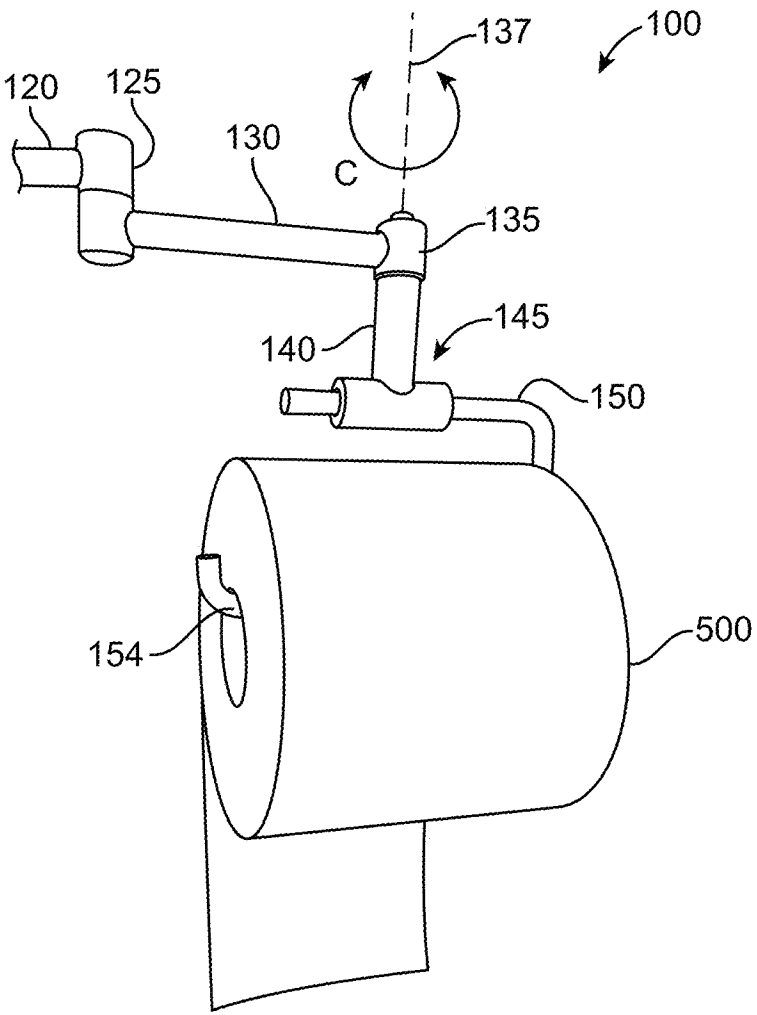

FIGS. 15A and 15B show aspects of an exemplary toilet paper holder system 100, according to embodiments of the present invention. FIG. 15A depicts toilet paper roll 500 in an under the top orientation, and FIG. 15B depicts toilet paper roll 500 in an over the top configuration. As disclosed throughout the instant application, the terms "under-the-top" and "under-the-roll" can be used interchangeably. Similarly, the terms "over-the-top" and "over-the-roll" can be used interchangeably. Toilet paper holder system 100 includes, among other things, a first arm 120, a second arm 130, a third arm 140, and a holder arm 150. The first arm 120 can be coupled with a wall mount via a first bearing mechanism as described elsewhere herein. The second arm 130 is coupled with the first arm 120 via a second bearing mechanism 125. The third arm 140 is coupled with the second arm 130 via a third bearing mechanism 135. The holder arm 150 is coupled with the third arm 140 via a fourth bearing mechanism 145. The holder arm 150 has a distal section 154 that is configured to support the roll of toilet paper 500. The third bearing mechanism 135 can enable the third arm 140 to pivot about a vertical axis, throughout a range of motion, relative to the second arm 130. For example, the third bearing mechanism 135 can enable the third arm 140 to pivot about the third axis 137 throughout a range of motion C (e.g. angle of about 360°) relative to a distal second arm knuckle, as described elsewhere herein with reference to FIG. 6. In exemplary embodiments, the third axis 137 can be parallel with the wall of a bathroom, and perpendicular to the floor of the bathroom. The third axis 137 can also be parallel with the first axis (e.g. first axis 117 depicted in FIG. 3), and/or the second axis (e.g. second axis 127 depicted in FIG. 5). Rotation of third arm 140 allows the orientation of the roll of toilet paper 500 to be selected as desired. For example, as depicted here, the roll of toilet paper 500 is in an under-the-roll orientation in FIG. 15A, and in an over-the-top orientation in FIG. 15B. The orientation of the roll can be changed via rotation of the third arm 140 about axis 137.

Most toilet paper rolls in use today are not located in the optimal position and/or orientation for dispensing toilet paper in the most convenient and efficient manner. This is because of the layout and design of most residential bathrooms, the design limitations of existing toilet paper holders, and varying user preferences. Embodiments of the present invention provide improved toilet paper holder systems and methods that enable placement of the roll at a position that is between about 18 inches and 24 inches off the floor. Exemplary embodiments enable placement of the roll at a position that is between about 18 inches and about 24 inches in front of the toilet during use. Certain embodiments enable dispensation of paper directly toward the user from the front (e.g. rather than perpendicular to the user). What is more, exemplary embodiments have the ability to enable the user to flip back and forth between "over-the-roll" and "under-the-roll" dispensation at will for different users. Further, exemplary embodiments enable firm anchoring to the wall, so it does not become detached during use. What is more, exemplary embodiments can be easily loaded with a new roll (e.g. accomplished by a user with only one hand). Still further, exemplary embodiments provide for the ability to be conveniently stowed out of the flow of traffic when not in use.

Many existing toilet paper toilet paper holder configurations in use today suffer from one or all of the following suboptimal flaws. First, they are located to the side or slightly behind us on the vanity or adjacent wall. Second, they are aimed perpendicular to the direction that the user wants the paper dispensed. Third, their anchor points are weakly mounted in only drywall and prone to failure. Fourth, the holders cannot be mounted on the opposite wall to the toilet because the wall is just a little too far away from the toilet to reach the toilet paper roll in a practical way (e.g. due to the size of a typical bathtub). Fifth, the direction of the roll cannot be easily flipped from "over-the-Roll" to "under-the-roll". Sixth, portable pedestal holders do not conveniently stow tightly against a wall or out of the way (e.g. due their wide base), and thus may present a tripping hazard. The most common design found in residential bathrooms, namely the double attachment point, double-support frame with spring-loaded collapsible spindle, suffers from not just some but all of these flaws. Perhaps the most frustrating of these flaws is the nature of the attachment points of the holder to the supporting wall structure. This configuration typically has two attachment points laterally separated 4 inches to 5 inches apart. This is a structural design limitation because typical residential-bathroom walls have ⅝" drywall supported by 2×4 studs at 16"-on-center placement. Moreover, the vanity placement and/or size can prevent effective placement of the typical holder. This disconnect between the holder and the wall requires compromise, particularly with existing static holder designs. Such designs force the user to make an unworkable decision, for example between positioning the holder to dispense toilet paper optimally based on the position of the toilet, or placing the holder so that one attachment-point anchor is supported by a stud. With such existing designs, positioning the holder to have both attachment-point anchors mounted into wall studs is impossible. At least one attachment-point anchor must therefore be anchored into weaker drywall alone, which leads to common anchor failures.

In contrast to the drawbacks of existing holder designs as noted above, embodiments of the present invention can combine one or more of the following traits, technologies, and functionalities to result in an improved solution. First, exemplary embodiments of the present invention provide flexibility of spatial position offered by the double swing arm, triple pivoting joint configuration. Exemplary embodiments of the present invention also provide employment of a double swing arm, triple pivoting joint configuration which is unique for the purposes of holding and dispensing toilet paper from a typical roll of toilet paper. Exemplary embodiments encompass designed interaction between the three bearing mechanisms (e.g. 115, 125, 135) and the two articulating arms (e.g. 120, 130) and the holder arm (150), and therefore the utilized toilet paper roll can be positioned in a greater variety of locations in a plane parallel to the floor. What is more, exemplary embodiments enable a high degree of versatility of positioning the toilet paper roll in a particular floor-parallel plane than any other non-pedestal toilet paper holder. Still further, embodiments of the present invention enable customizability of the interchangeable arms and bearing mechanisms to create configurations that meet specific needs. Exemplary swivel joints in the bearing mechanisms are designed to be easily disassembled and reassembled at will.

Still further, in exemplary embodiments the arms (e.g. 120, 130) and the bearing mechanisms (e.g. 115, 125, 135) are interchangeable and the bearing mechanisms (e.g. 115, 125, 135) can be easily disassembled, and therefore the toilet paper holder system can be easily modified to suit many situations. Additional embodiment variations that can result from the combining, rearranging, adding, or eliminating certain elements of the overall design include, for example: (A) one non-telescoping arm (e.g. 120) and two bearing mechanisms (e.g. 115, 135), (B) one telescoping arm (e.g. 130) and two bearing mechanisms (e.g. 115, 135), (C) two arms (e.g. 120, 130) and three bearing mechanisms (e.g. 115, 125, 135) with the telescoping arm (e.g. 130) being the more proximal arm and the non-telescoping arm (e.g. 120) being the more distal arm to the mounting plate, (D) two non-telescoping arms (e.g. 120) and three bearing mechanisms (e.g. 115, 125, 135), (E) two telescoping arms (e.g. 130) and three bearing mechanisms (e.g. 115, 125, 135), and (F) three or more arm, four or more bearing-mechanism varieties.

According to some embodiments, systems and methods can enable one handed, convenient adjustability of the dispensing rotation direction of the toilet paper roll without the need to remove the toilet paper roll from the holder. According to some embodiments, the relative position of the third bearing mechanism (e.g. 135) to the third axis (e.g. 137), the third arm (e.g. 140), and the holder arm (e.g. 150) allows for the dispensing rotation direction of the toilet paper roll to be easily be flipped with one hand from "over-the-roll" to "under-the-roll" without materially changing the position of the overall roll in space and without removing the toilet paper roll from the holder. Embodiments of the present invention also provide the convenience of being mounted to a support wall rather than resting on the floor. Exemplary embodiments have most of the desired positional flexibility of a pedestal style toilet paper holder while possessing the trait of being attached to the wall instead of resting on the floor. Exemplary embodiments also provide stowability of the double swing arm design in combination with wall-mounted design. Unlike a pedestal, exemplary embodiments can be more compactly stored out of the flow of traffic against the mounting wall in a more convenient manner so as not to remain a tripping hazard. Exemplary embodiments also enable the practicality of vertically stacked attachment-point anchors to ensure secure mounting into wall studs. Further, exemplary embodiments enable the convenience of being able to lock and unlock the position of the toilet paper roll with set screws in the bearing mechanisms. According to exemplary embodiments, because of the incorporate of set screws on all three bearing mechanisms, the position of the toilet paper holder can be locked in space if desired. Exemplary embodiments also enable the ability to design to match existing styles of decorative bathroom hardware. What is more, exemplary embodiments enable affordability.

Figure 16A:
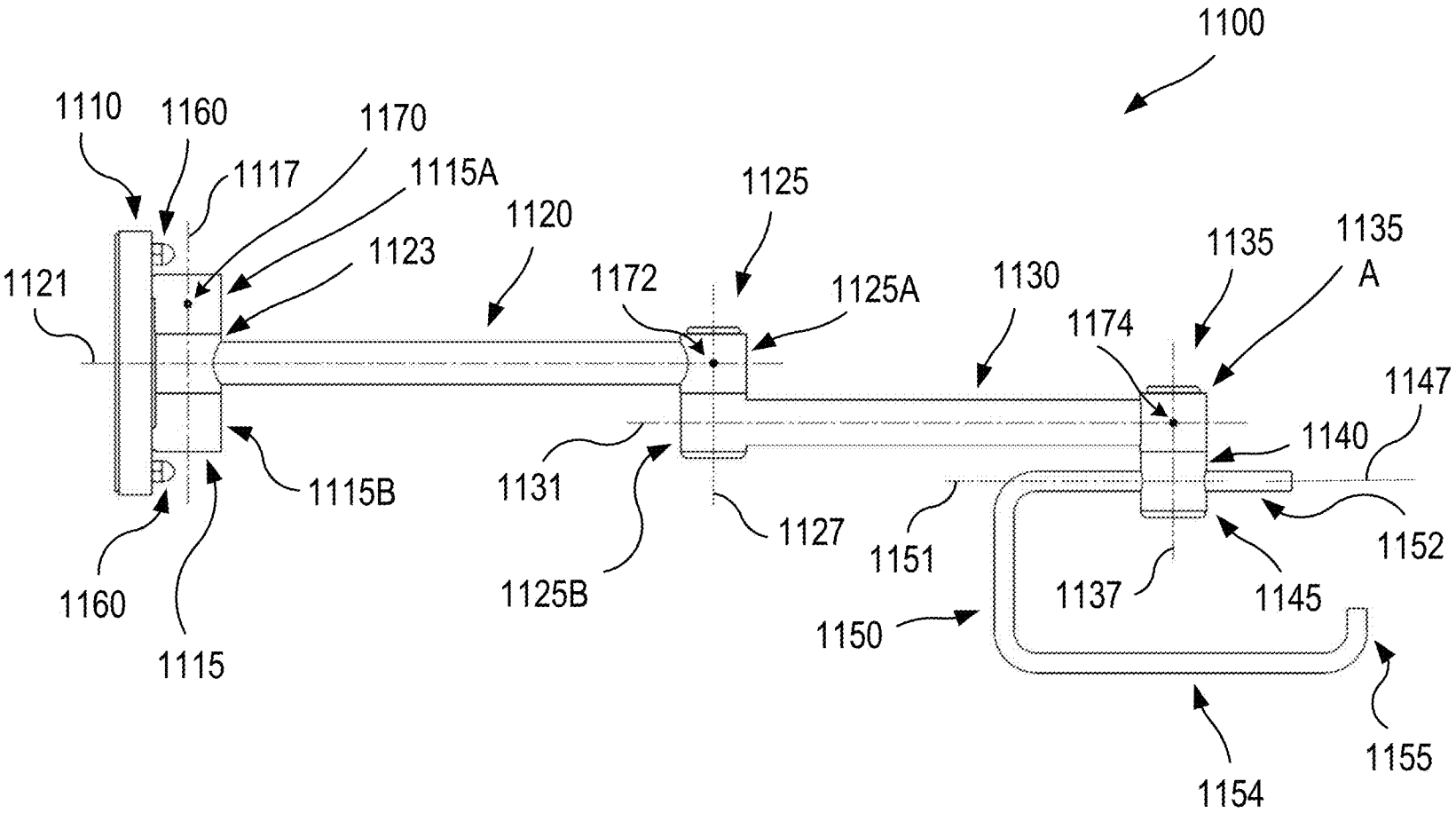
FIGS. 16A to 16C depict various views of a toilet paper holder and dispenser system, according to embodiments of the present invention.
Figure 16B:
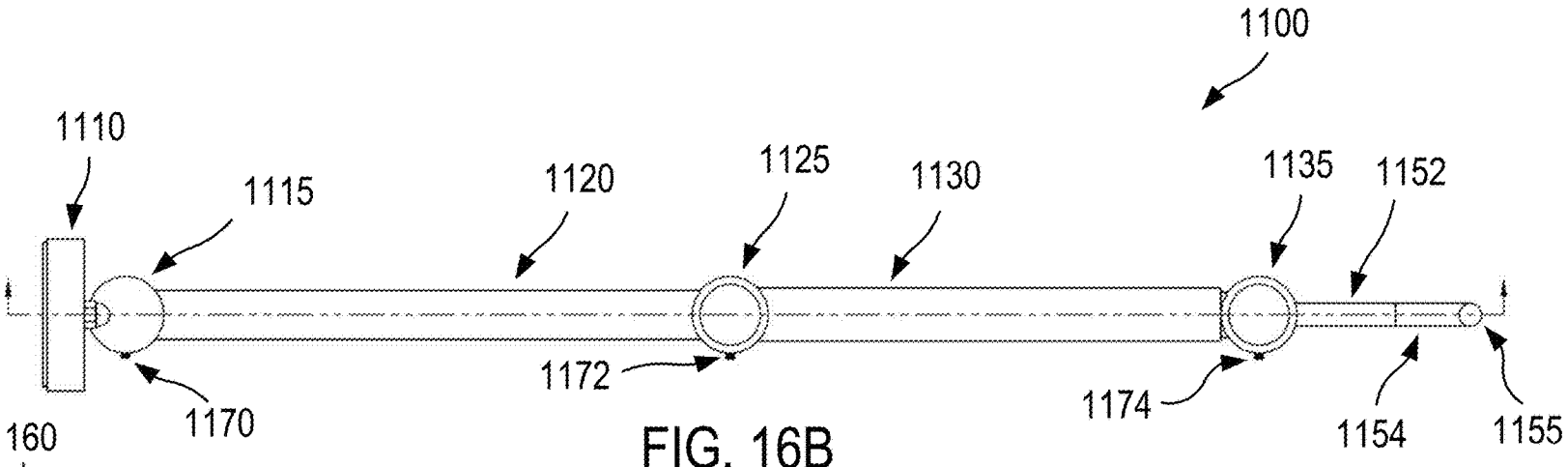
Figure 16C:
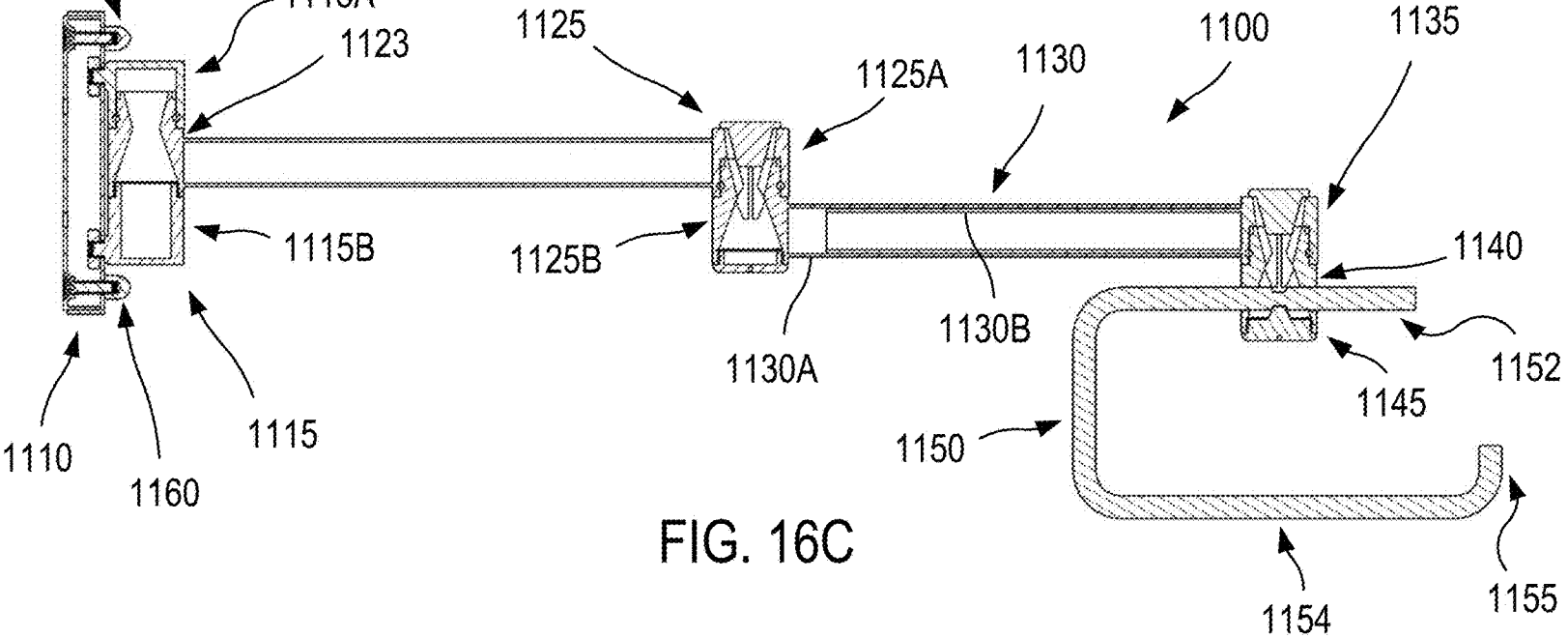

FIGS. 16A to 16C depict various views of a toilet paper holder system 1100 according to embodiments of the present invention. As shown here, toilet paper holder system includes a wall mount 1110, a first arm 1120, a second arm 1130, a third arm 1140, and a holder arm 1150. The first arm 1120 is coupled with the wall mount 1110 via a first bearing mechanism 1115. The second arm 1130 is coupled with the first arm 1120 via a second bearing mechanism 1125. The third arm 1140 is coupled with the second arm 1130 via a third bearing mechanism 1135. The holder arm 1150 is coupled with the third arm 1140 via a fourth bearing mechanism 1145. The holder arm 1150 has a proximal section 1152 and a distal section 1154. The distal section 1154 of the holder arm 1150 is configured to support a roll of toilet paper (not shown).

As shown here, the first bearing mechanism 1115 enables the first arm 1120 to pivot about a first axis 1117 throughout a range of motion. The second bearing mechanism 1125 enables the second arm 1130 to pivot about a second axis 1127, throughout a range of motion, relative to the first arm 1120. The first arm has a central longitudinal axis 1121. As shown here, the first bearing mechanism 1115 includes an upper mount knuckle 1115A and a lower mount knuckle 1115B. The first bearing mechanism 1115 also includes a proximal first arm knuckle 1123, disposed between the upper mount knuckle 1115A and the lower mount knuckle 1115B. In operation, the proximal first arm knuckle 1123 can rotate relative to the upper mount knuckle 1115A and the lower mount knuckle 1115B. In some cases, the upper mount knuckle 1115A and the lower mount knuckle 1115B remain fixed relative to the mount 1110, while the proximal first arm knuckle 1123 swings or pivots relative to the mount 1110. The first bearing mechanism 1115 enables the first arm 1120 to pivot about a first axis 1117 throughout a range of motion.

The second arm 1130 has a central longitudinal axis 1131. As shown here, the second bearing mechanism 1125 includes a distal first arm knuckle 1125A and a proximal second arm knuckle 1125B. In operation, the distal first arm knuckle 1125A and the proximal second arm knuckle 1125B can rotate relative to one another. The second bearing mechanism 1125 enables the second arm 1130 to pivot about a second axis 1127, throughout a range of motion, relative to the first arm 1120. According to some embodiments, the second bearing mechanism 1125 can be provided as a hinge, as described elsewhere herein.

The toilet paper holder system 1100 includes a third arm 1140 pivotably coupled with the second arm 1130 via a third bearing mechanism 1135. The third bearing mechanism 1135 can include a distal second arm knuckle 135A. In some cases, a distal portion of the second arm 1130 can be pivotably attached with a proximal portion of the third arm 1140 via the third bearing mechanism 1135. The third bearing mechanism 1135 can enable the third arm 1140 to pivot about a third axis 1137, throughout a range of motion, relative to the second arm 1130. The third axis 1137 can also be parallel with the first axis 1117 and/or the second axis 1127. According to some embodiments, the third bearing mechanism 1135 can be provided as a hinge, as described elsewhere herein.

The toilet paper holder system 1100 can include a third arm 1140 pivotably coupled with a second arm 1130 via a third bearing mechanism 1135, and a holder arm coupled with the third arm 1140 via a fourth bearing mechanism 1145. In some cases, a portion of the third arm 1140 can be pivotably attached with a proximal portion 1152 of the holder arm 1150 via the fourth bearing mechanism 1145. The proximal section 1152 has a central longitudinal axis 1151. The fourth bearing mechanism 145 can enable the holder arm 150 to pivot about a fourth axis 1147, throughout a range of motion, relative to the third arm 1140. The fourth axis 1147 can also be perpendicular with the third axis (e.g. third axis 1137). According to some embodiments, the fourth bearing mechanism 1145 can be provided as a hinge, as described elsewhere herein.

According to some embodiments first arm 1120, second arm 1130, and/or third arm 1140 can be manufactured to different lengths depending upon the desired application. In some embodiments, first arm 1120, second arm 1130, and/or third arm 1140 can have adjustable lengths. In some embodiments, first arm 1120, second arm 1130, and/or third arm 1140 can have telescoping capabilities. In some cases, second arm 1130 has a telescoping capability and its length can be changed within certain limits. As shown here, second arm 1130 can include an outer telescoping arm 1130 and an inner telescoping arm 1130B. According to some embodiments, bearing mechanisms 1115, 1125, and/or 1135 can be locked in any orientation by use of a set mechanism, such as a set screw. As shown here, first bearing mechanism 1115 includes a first set screw 1170, second bearing mechanism 1125 includes a second set screw 1172, and third bearing mechanism 1135 includes a third set screw 1174. According to some embodiments, wall mount 1110 can be securely mounted into any wall stud using mounting hardware 1160, which may include 2 screw anchors.

Figure 17A:
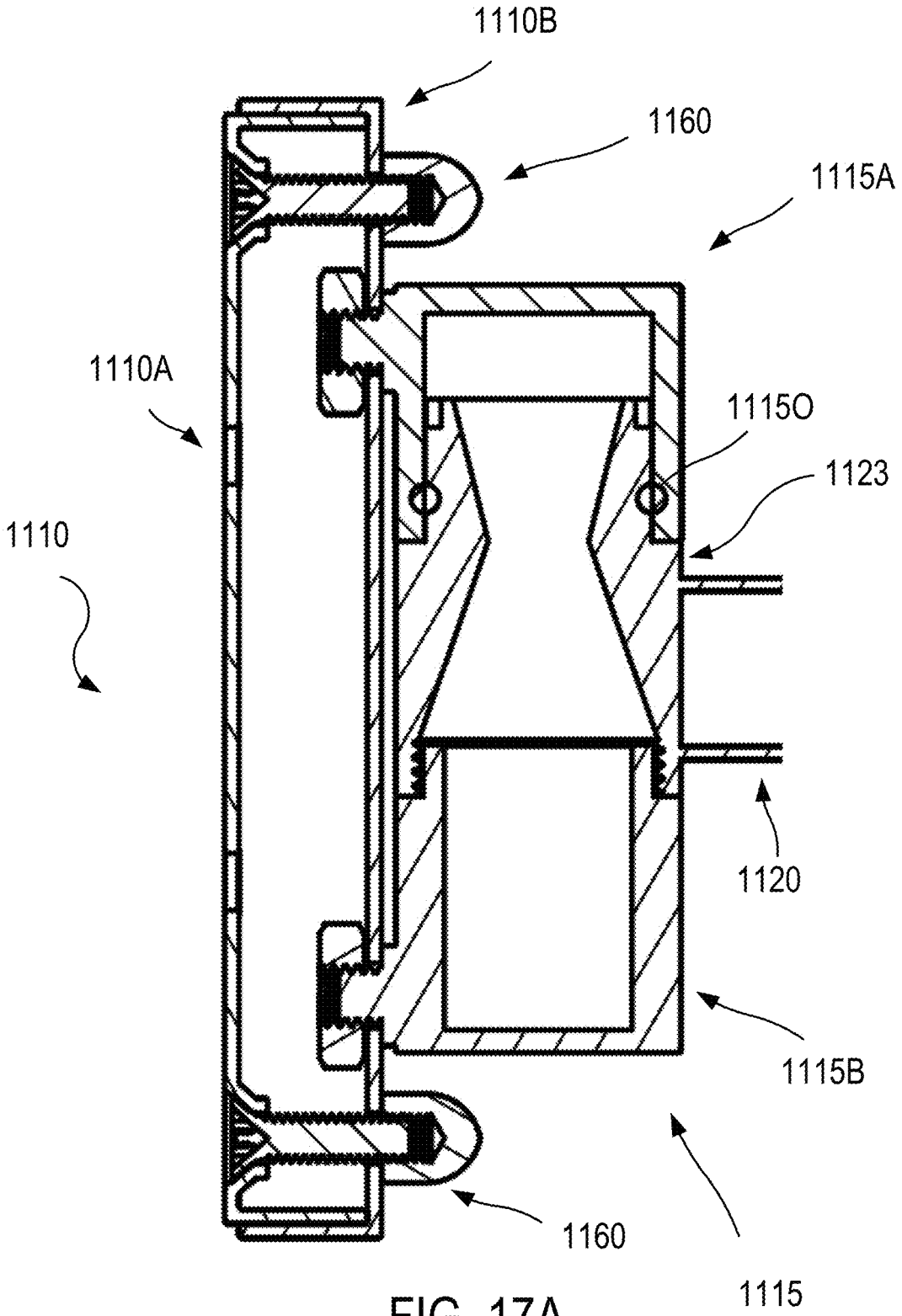
FIGS. 17A to 17C depict various views of aspects of a toilet paper holder and dispenser system, according to embodiments of the present invention.

FIG. 17A provides a cross-section view of a first bearing mechanism 1115. As shown here, first bearing mechanism 1115 includes an upper mount knuckle 1115A and a lower mount knuckle 1115B. The first bearing mechanism 1115 also includes a proximal first arm knuckle 1123, disposed between the upper mount knuckle 1115A and the lower mount knuckle 1115B. In operation, the proximal first arm knuckle 1123 can rotate relative to the upper mount knuckle 1115A and the lower mount knuckle 1115B. In some cases, the upper mount knuckle 1115A and the lower mount knuckle 1115B remain fixed relative to the mount 1110, while the proximal first arm knuckle 1123 swings or pivots relative to the mount 1110. The first bearing mechanism 1115 enables the first arm 1120 to pivot about a first axis 1117 throughout a range of motion. The mount 1110 includes an inner nesting wall mount plate 1110A and an outer nesting wall mount plate 1110B. As discussed elsewhere herein, bearing mechanisms can include friction elements. As shown here, first bearing mechanism 1115 includes a first rubber friction O-ring 1115O.

Figure 17B:
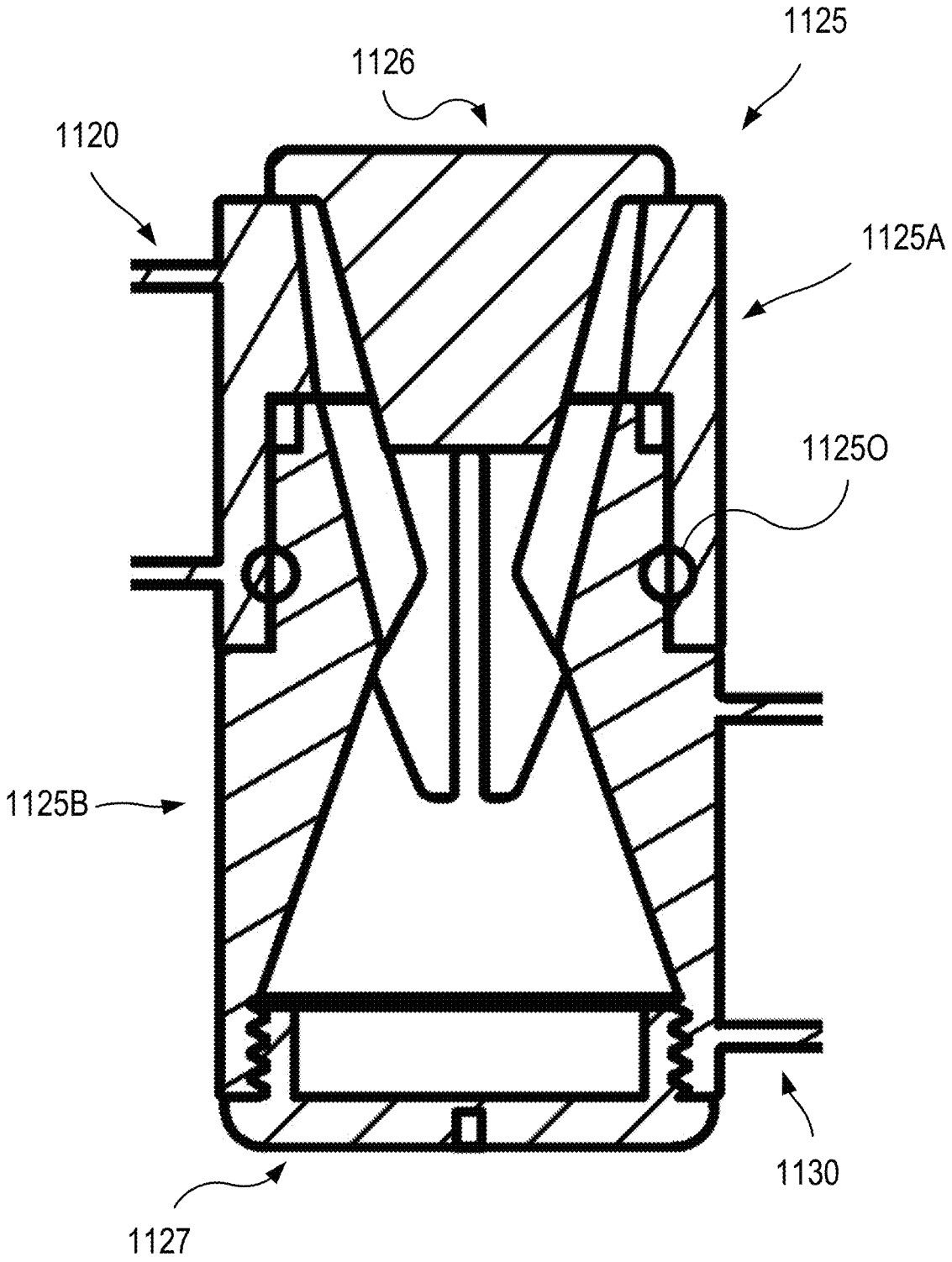

FIG. 17B provides a cross-section view of a second bearing mechanism 1125. As shown here, the second bearing mechanism 1125 includes a distal first arm knuckle 1125A and a proximal second arm knuckle 1125B. In operation, the distal first arm knuckle 1125A and the proximal second arm knuckle 1125B can rotate relative to one another. The second bearing mechanism 1125 enables the second arm 1130 to pivot about an axis throughout a range of motion, relative to the first arm 1120. The second bearing mechanism 1125 also includes a snap top 1126 and a screw base 1127. As discussed elsewhere herein, bearing mechanisms can include friction elements. As shown here, second bearing mechanism 1125 includes a second rubber friction O-ring 1125O.

Figure 17C:
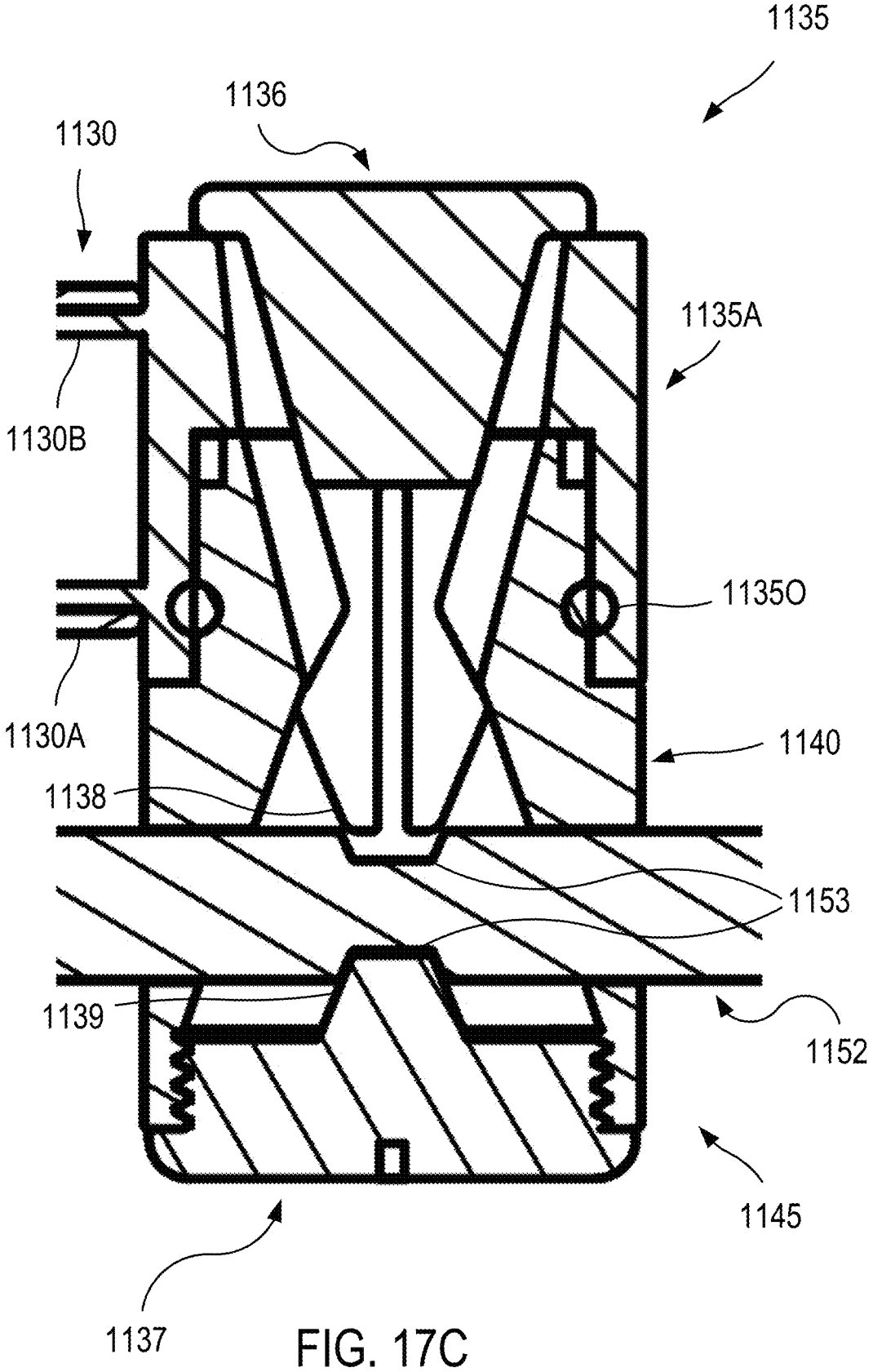

FIG. 17C provides a cross-section view of a third bearing mechanism 1135 and a fourth bearing mechanism 1145. As shown here, the third bearing mechanism 1135 includes a distal second arm knuckle 1135A. In some cases, a distal portion of the second arm 1130 can be pivotably attached with a portion of the third arm 1140 via the third bearing mechanism 1135. The third bearing mechanism 1135 can enable the third arm 1140 to pivot about an axis, throughout a range of motion, relative to the second arm 1130. According to some embodiments, the third bearing mechanism 1135 can be provided as a hinge, as described elsewhere herein.

A toilet paper holder system can include a third arm 1140 pivotably coupled with a second arm 1130 via a third bearing mechanism 1135, and a holder arm can be coupled with the third arm 1140 via a fourth bearing mechanism 1145. In some cases, a portion of the third arm 1140 can be pivotably attached with a proximal portion 1152 of the holder arm via the fourth bearing mechanism 1145. The fourth bearing mechanism 1145 can enable the holder arm to pivot about an axis, throughout a range of motion, relative to the third arm 1140. As shown here, the fourth bearing mechanism 1145 can be provided by a distal tip 1138 of a snap top 1136 and a distal tip 1139 of a screw base 1137 operating in concert with a circumferential notch 1153 of the holder. In this way, the holder can pivot or rotate relative to the third arm 1140, and the distal tips 1137, 1139 operate to keep the holder from sliding laterally out of or relative to the third arm 1140. As discussed elsewhere herein, bearing mechanisms can include friction elements. As shown here, third bearing mechanism 1135 includes a third rubber friction O-ring 1135O.

Figure 18A:
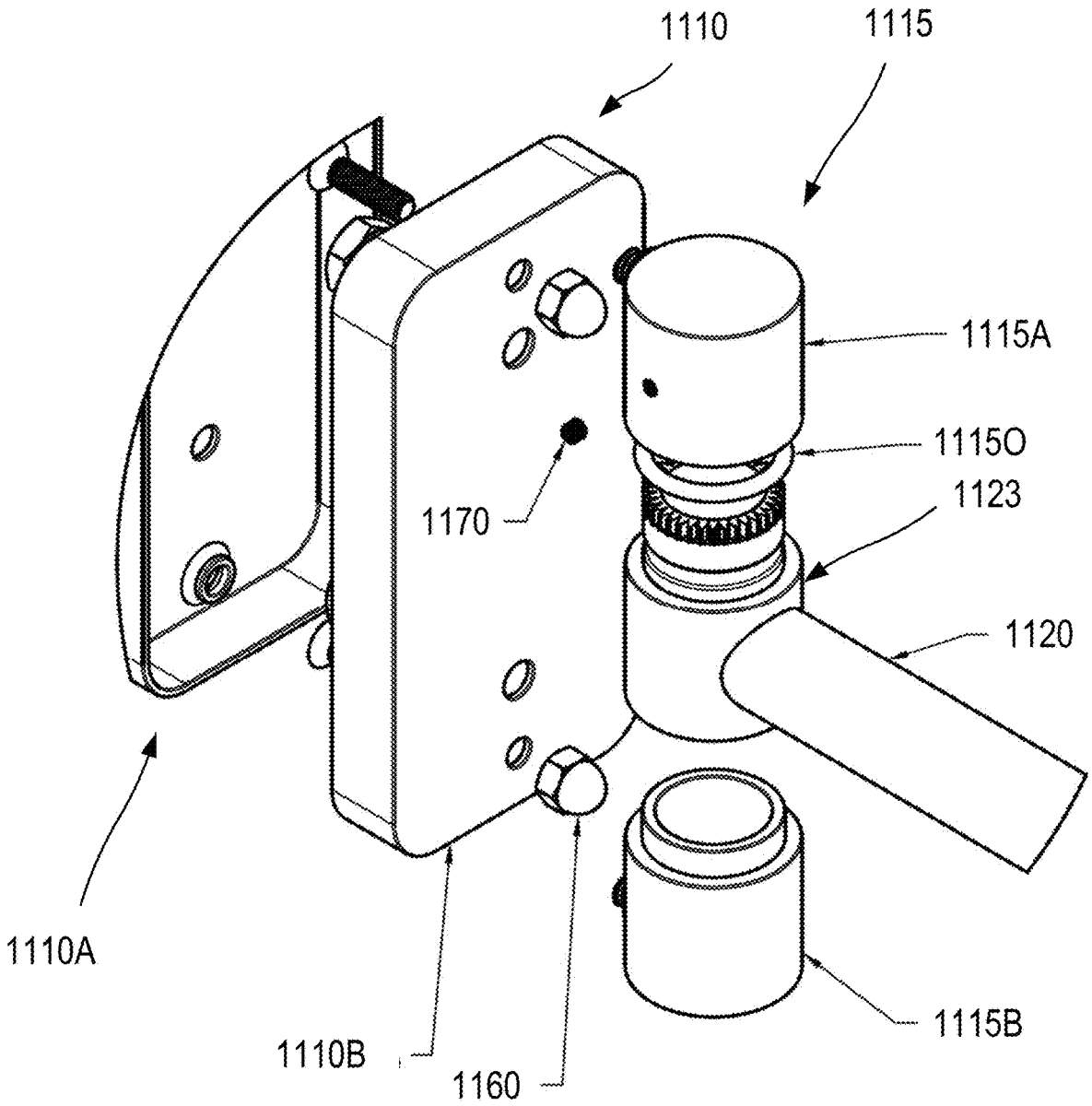
FIGS. 18A to 18C depict various views of aspects of a toilet paper holder and dispenser system, according to embodiments of the present invention.

FIG. 18A provides an exploded view of a first bearing mechanism 1115. As shown here, first bearing mechanism 1115 includes an upper mount knuckle 1115A and a lower mount knuckle 1115B. The first bearing mechanism 1115 also includes a proximal first arm knuckle 1123, disposed between the upper mount knuckle 1115A and the lower mount knuckle 1115B. In operation, the proximal first arm knuckle 1123 can rotate relative to the upper mount knuckle 1115A and the lower mount knuckle 1115B. In some cases, the upper mount knuckle 1115A and the lower mount knuckle 1115B remain fixed relative to the mount 1110, while the proximal first arm knuckle 1123 swings or pivots relative to the mount 1110. The first bearing mechanism 1115 enables the first arm 1120 to pivot about a first axis 1117 throughout a range of motion. The mount 1110 includes an inner nesting wall mount plate 1110A and an outer nesting wall mount plate 1110B. As discussed elsewhere herein, bearing mechanisms can include friction elements. As shown here, first bearing mechanism 1115 includes a first rubber friction O-ring 1115O. First bearing mechanism 1115 also includes a first set screw 1170. The wall mount 1110 can also include mounting hardware 1160.

Figure 18B:
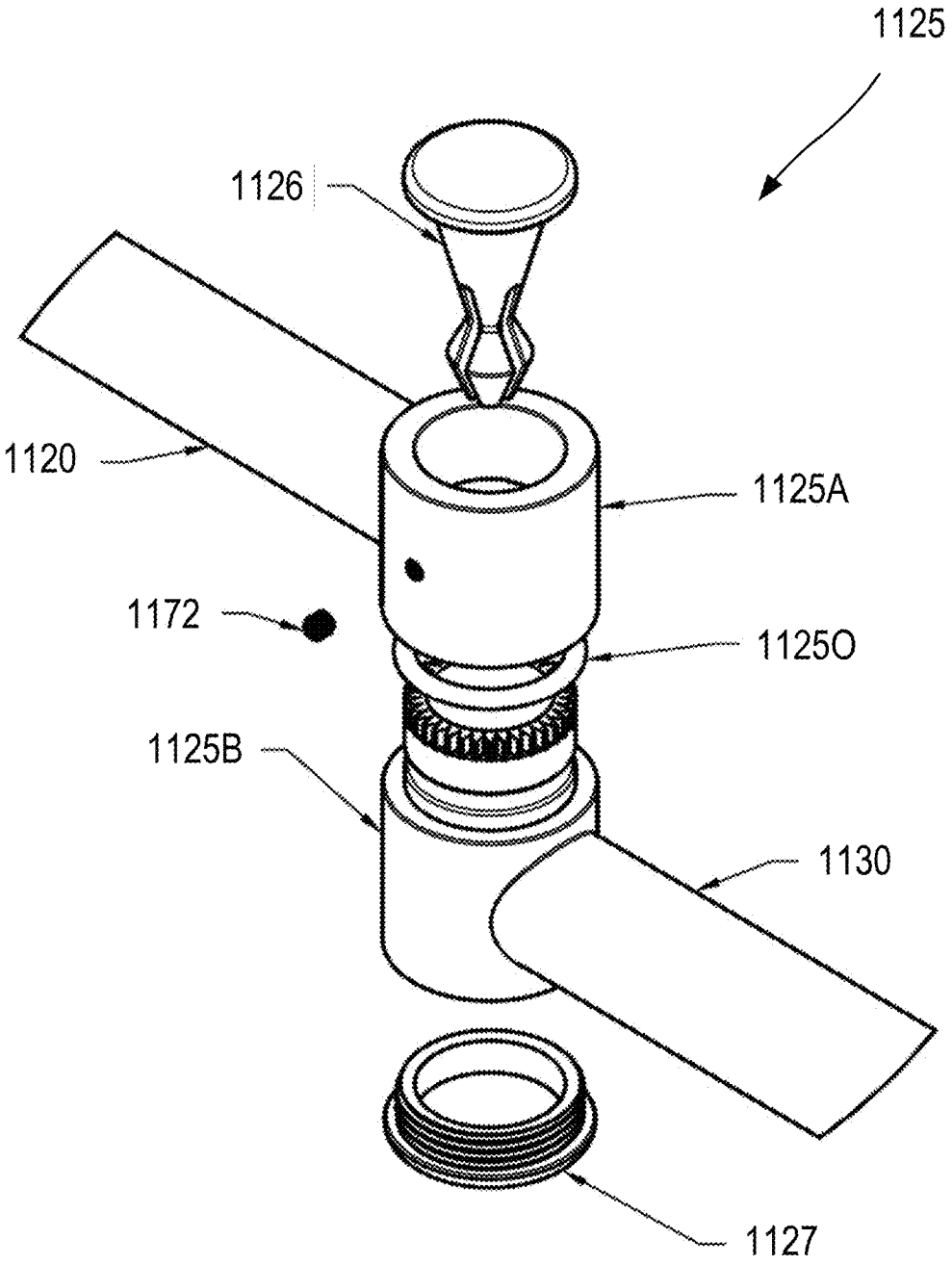

FIG. 18B provides an exploded view of a second bearing mechanism 1125. As shown here, the second bearing mechanism 1125 includes a distal first arm knuckle 1125A and a proximal second arm knuckle 1125B. In operation, the distal first arm knuckle 1125A and the proximal second arm knuckle 1125B can rotate relative to one another. The second bearing mechanism 1125 enables the second arm 1130 to pivot about an axis throughout a range of motion, relative to the first arm 1120. The second bearing mechanism 1125 also includes a snap top 1126 and a screw base 1127. As discussed elsewhere herein, bearing mechanisms can include friction elements. As shown here, second bearing mechanism 1125 includes a second rubber friction O-ring 1125O. Second bearing mechanism 1125 also includes a second set screw 1172.

Figure 18C:
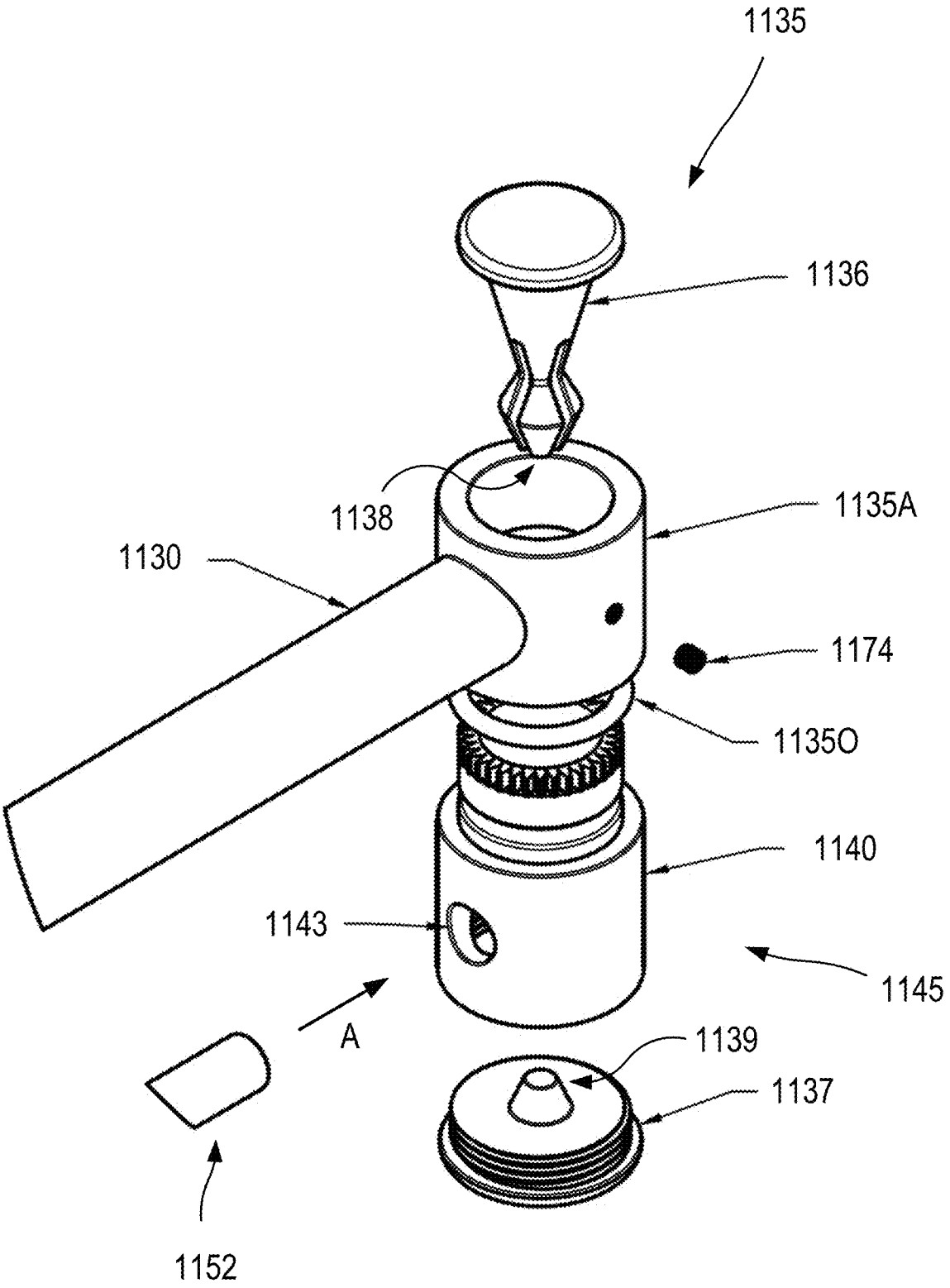

FIG. 18C provides an exploded view of a third bearing mechanism 1135 and a fourth bearing mechanism 1145. As shown here, the third bearing mechanism 1135 includes a distal second arm knuckle 1135A. In some cases, a distal portion of the second arm 1130 can be pivotably attached with a portion of the third arm 1140 via the third bearing mechanism 1135. The third bearing mechanism 1135 can enable the third arm 1140 to pivot about an axis, throughout a range of motion, relative to the second arm 1130. According to some embodiments, the third bearing mechanism 1135 can be provided as a hinge, as described elsewhere herein. As shown here, the third arm 1140 can include an aperture 1143 for receiving a holder. For example, a distal portion of a holder 1152 can be inserted therethrough, as indicated by arrow A.

A toilet paper holder system can include a third arm 1140 pivotably coupled with a second arm 1130 via a third bearing mechanism 1135, and a holder arm can be coupled with the third arm 1140 via a fourth bearing mechanism 1145. In some cases, a portion of the third arm 1140 can be pivotably attached with a proximal portion 1152 of the holder arm via the fourth bearing mechanism 1145. The fourth bearing mechanism 1145 can enable the holder arm to pivot about an axis, throughout a range of motion, relative to the third arm 1140. As shown here, the fourth bearing mechanism 1145 can be provided by a distal tip 1138 of a snap top 1136 and a distal tip 1139 of a screw base 1137 operating in concert with a circumferential notch of the holder. In this way, the holder can pivot or rotate relative to the third arm 1140, and the distal tips 1137, 1139 operate to keep the holder from sliding laterally out of or relative to the third arm 1140. As discussed elsewhere herein, bearing mechanisms can include friction elements. As shown here, third bearing mechanism 1135 includes a third rubber friction O-ring 1135O. Third bearing mechanism 1135 also includes a third set screw 1174.

Although embodiments of the present invention have been explained in relation to one or more preferred embodiments, it is to be understood that many other possible modifications and variations can be made without departing from the spirit and scope of the invention.

All features of the described systems and devices are applicable to the described methods mutatis mutandis, and vice versa. Embodiments of the present invention encompass kits having systems for holding and toilet paper roll as disclosed herein. In some embodiments, the kit includes one or more systems for holding and dispensing a toilet paper roll, along with instructions for using the system for example according to any of the methods disclosed herein.

Although the foregoing invention has been described in some detail by way of illustration and example for purposes of clarity of understanding, one of skill in the art will appreciate that certain changes, modifications, alternate constructions, and/or equivalents may be practiced or employed as desired, and within the scope of the appended claims. In addition, each reference provided herein in incorporated by reference in its entirety to the same extent as if each reference was individually incorporated by reference. Relatedly, all publications, patents, patent applications, journal articles, books, technical references, and the like mentioned in this specification are herein incorporated by reference to the same extent as if each individual publication, patent, patent application, journal article, book, technical reference, or the like was specifically and individually indicated to be incorporated by reference.

What is claimed is:

1. A toilet paper holder and dispenser system for holding a roll of toilet paper, the system comprising:

a wall mount;

a bearing mechanism in operative association with the wall mount, the bearing mechanism having a proximal portion and a distal portion; and a holder arm having a holder arm distal section and a hook, wherein the holder arm distal section is configured to hold a roll of toilet paper, wherein the hook is configured to inhibit the roll of toilet paper from sliding off the holder arm distal section, wherein the holder arm is configured to rotate relative to the bearing mechanism between a first position where a roll of toilet paper on the holder arm distal section is in an over-the-top orientation and a second position where the roll of toilet paper on the holder arm distal section is in an under-the-roll orientation, and wherein the holder arm distal section is configured to hold the roll of toilet paper below the bearing mechanism while the holder arm rotates between the first and second positions.

2. The toilet paper holder and dispenser system of claim 1, wherein the bearing mechanism defines a central longitudinal axis, and wherein the central longitudinal axis intersects the holder arm distal section while the holder arm rotates between the first and second positions.

3. The toilet paper holder and dispenser system of claim 2, wherein the bearing mechanism enables the holder arm to pivot about the central longitudinal axis.

4. The toilet paper holder and dispenser system of claim 1, wherein the bearing mechanism enables the holder arm to rotate throughout an angle of rotation that is at least 180°.

5. The toilet paper holder and dispenser system of claim 1, wherein the bearing mechanism is positioned superior to the holder arm.

6. The toilet paper holder and dispenser system of claim 1, wherein the wall mount is positioned superior to the holder arm.

7. The toilet paper holder and dispenser system of claim 1, wherein the wall mount is positioned superior to the bearing mechanism.

8. The toilet paper holder and dispenser system of claim 1, wherein the wall mount is positioned superior to the bearing mechanism, and wherein the bearing mechanism is positioned superior to the holder arm.

9. The toilet paper holder and dispenser system of claim 1, wherein the holder arm distal section is configured to hold the roll of toilet paper below the wall mount while the holder arm rotates between the first and second positions.

10. A wall mount for securing an item to a structure of a building, the wall mount comprising:

an inner nesting wall mount plate;

an outer nesting wall mount plate; and a mounting hardware that secures the inner nesting wall mount plate and the outer nesting wall mount plate to the structure of the building, wherein the outer nesting wall mount plate is configured to at least partially receive the inner nesting wall mount plate, and wherein the outer nesting wall mount plate is configured to engage the item, wherein the inner nesting wall mount plate comprises a back surface configured to face toward the structure of the building, and an inner flange, wherein the outer nesting wall mount plate comprises a back surface configured to face toward the structure of the building, and an outer flange, wherein the inner flange of the inner nesting wall mount plate is nested within the outer flange of the outer nesting wall mount plate, and wherein the outer flange of the outer nesting wall mount plate does not contact the structure of the building when the mounting hardware secures the inner nesting wall mount plate and the outer nesting wall mount plate to the structure of the building.

11. The wall mount of claim 10, wherein the item is a bearing mechanism of a toilet paper holder and dispenser system.

12. The wall mount of claim 10, wherein the structure is a wall.

13. The wall mount of claim 10, wherein the mounting hardware comprises two screw anchors.

* * * * *